US008948638B2

(12) United States Patent
Ishikura et al.

(10) Patent No.: US 8,948,638 B2
(45) Date of Patent: Feb. 3, 2015

(54) IMAGE FORMING APPARATUS

(75) Inventors: Yuji Ishikura, Kanagawa (JP); Yasuyuki Ishii, Tokyo (JP); Hideki Kosugi, Kanagawa (JP); Tetsuro Hirota, Kanagawa (JP); Masaaki Yamada, Tokyo (JP); Yoshiko Ogawa, Tokyo (JP); Atsushi Kurokawa, Kanagawa (JP); Hideyasu Seki, Tokyo (JP); Masanori Horike, Kanagawa (JP); Shin Kayahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 754 days.

(21) Appl. No.: 13/215,700

(22) Filed: Aug. 23, 2011

(65) Prior Publication Data

US 2012/0057891 A1 Mar. 8, 2012

(30) Foreign Application Priority Data

Sep. 7, 2010 (JP) ..... 2010-200030
Jun. 3, 2011 (JP) ..... 2011-125383

(51) Int. Cl.

*G03G 15/06* (2006.01)
*G03G 15/08* (2006.01)
*G03G 15/01* (2006.01)
*G03G 15/16* (2006.01)

(52) U.S. Cl.

CPC ..... *G03G 15/0131* (2013.01); *G03G 15/0189* (2013.01); *G03G 15/1605* (2013.01)
USPC ..... 399/55; 399/285

(58) Field of Classification Search

CPC ..... G03G 15/0818; G03G 15/0844; G03G 15/0848
USPC ..... 399/29, 55, 285, 289
See application file for complete search history.

(56) References Cited

U.S. PATENT DOCUMENTS

| | | | |
|---|---|---|---|
| 2008/0286015 | A1 | 11/2008 | Kadota et al. |
| 2009/0016781 | A1 | 1/2009 | Takahashi et al. |
| 2009/0022523 | A1 | 1/2009 | Kadota et al. |
| 2009/0035025 | A1 | 2/2009 | Ishii et al. |
| 2011/0064432 | A1 | 3/2011 | Horike et al. |

FOREIGN PATENT DOCUMENTS

| | | | | |
|---|---|---|---|---|
| JP | 60118866 | A | * | 6/1985 |
| JP | 10186861 | A | * | 7/1998 |
| JP | 2001265071 | A | * | 9/2001 |
| JP | 2006243115 | A | * | 9/2006 |
| JP | 2010-60830 | | | 3/2010 |
| JP | 2010-60918 | | | 3/2010 |
| JP | 2011065158 | A | * | 3/2011 |

* cited by examiner

*Primary Examiner* — Erika J Villaluna
(74) *Attorney, Agent, or Firm* — Oblon, Spivak, McClelland, Maier & Neustadt, L.L.P.

(57) ABSTRACT

An image forming apparatus includes a latent image carrier; a latent image writer to write a latent image on the latent image carrier; a developing unit including a toner carrier having first and second electrodes insulated via an insulator member and a voltage applying unit to apply voltages to the first and second electrodes having a potential difference to generate first electric fields to cause the toner to hop from the toner carrier to the latent image carrier to develop a toner image; and a transfer unit to transfer the developed toner image to a transferring member. When alternating voltages having a same phase and same amplitude are applied to the first and second electrodes to form second electric fields between the latent image carrier and the toner carrier, the toner is discharged from the toner carrier to the latent image carrier in a toner discharge mode.

20 Claims, 21 Drawing Sheets

TIME t2

TIME t1

TIME t1

TIME t2

IMAGE FORMING APPARATUS

BACKGROUND OF THE INVENTION

1. Field of the Invention

The disclosures herein relate to an image forming apparatus having a developing device configured to develop an image by attaching a toner hopping on a surface of a toner carrier to a latent image formed on a latent image carrier.

2. Description of the Related Art

Japanese Patent Application Publication No. 2010-60918 (hereinafter called "Patent Document 1") discloses an image forming apparatus of this kind. The developing device of the image forming apparatus disclosed in Patent Document 1 includes a rotatable cylindrical toner carrier roller. The cylindrical toner carrier roller includes long and slim electrodes elongated in a rotational axis direction arranged at predetermined pitches. Alternating electric fields are formed between the adjacently arranged long and slim electrodes on the surface of the cylindrical toner carrier roller. The toner may hop from directly above one of the adjacently arranged electrodes to the other, or vice versa based on directional changes of the alternating electric fields. The toner is then carried to a developing region facing the latent image carrier with a rotational movement of the toner carrier roller while reciprocally hopping between the adjacent electrodes. In the developing region, the toner hops from the surface of the toner carrier roller toward and neat to the latent image carrier and then is attracted by the electric fields formed by the electrostatic latent image. The toner attracted to the electrostatic latent image is attached to the latent image accordingly. The latent image is thus developed by the attachment of the toner.

An image forming apparatus of another kind is also generally known in the art. In such image forming apparatus, the toner is not simply carried by a surface movement of the toner carrier roller while reciprocally hopping between the electrodes but the hopping toner on the surface of toner carrier roller itself moves in a predetermined direction by the hopping behavior. For example, in the image forming apparatus having the toner carrier roller on which three electrodes A, B and C phases are repeatedly arranged in this order, the toner is transferred toward the developing region by allowing the toner to sequentially hop from the A phase electrode to the B phase electrode, the B phase electrode to the C phase electrode, the C phase electrode to the A phase electrode, and the like on the surface of the toner carrier roller.

With these kinds of image forming apparatuses utilizing the hopping toner for the development (hereinafter called a "hopping type developing system"), the low voltage development may be achieved to an extent which may not be achieved by the conventional one-component developing system or two-component developing system. For example, the toner may be selectively attached to the electrostatic latent image having a potential difference of several dozen fractional V between the latent image formed region and a peripheral non-image forming region.

However, if the electrostatic charge of the toner on the surface of the toner carrier roller is lowered, the toner exhibits insufficient hopping on the surface of the toner carrier roller, which may result in development degradation.

The image forming apparatus disclosed in Patent Document 1 is provided with a cleaner device, and the toner exhibiting inferior hopping behavior due to the lowered the electrostatic charge is caused to hop from the surface of the toner carrier roller onto the photoreceptor surface such that the toner is discharged from the surface of the toner carrier roller, and the cleaner device collects the discharged toner from the photoreceptor surface. After the toner is removed from the toner carrier roller, new toner having appropriate electrostatic charge is supplied on the surface of the toner carrier roller. Accordingly, the latent image is developed by attaching the toner exhibiting excellent hopping behavior on the toner carrier roller to a latent image formed on the photoreceptor. Thus, the occurrence of the development degradation may be reduced.

In the image forming apparatus disclosed in Patent Document 1, when the toner having a low electrostatic charge is discharged from the surface of the toner carrier roller, the toner is caused to hop from the surface of the toner carrier roller to the photoreceptor surface by applying alternating voltages having an amplitude greater than that for the developing process and having differing phases to the adjacent first and second electrodes while the toner is removed by the cleaner device. Accordingly, when the alternating voltages having the amplitude relatively greater than that for the developing process are applied to the first and the second electrodes of the toner carrier roller, the toner having the lowered electrostatic charge may hop to the photoreceptor to some extent.

However, if the potential difference between the first electrode and the second electrode is too large, the insulator between the first and the second electrodes may be broken due to current leakage having occurred between the first and the second electrodes. Further, if the alternating voltages having the potential difference that may induce no insulator breakage are applied to the first and the second electrodes while the surface of the toner carrier roller is being cleaned, the electric fields sufficiently large to cause the toner having the drastically lowered electrostatic charge to hop from the toner carrier roller to the photoreceptor may not be generated. In this case, the toner having the drastically lowered electrostatic charge may remain on the surface of the toner carrier roller without hopping from the toner carrier roller to the photoreceptor.

SUMMARY OF THE INVENTION

It is a general object of at least one embodiment of the present invention to provide an image forming apparatus capable of discharging the toner having the drastically lowered electrostatic charge from the toner carrier roller onto the latent image carrier while suppressing inducement of insulator breakage that substantially eliminates one or more problems caused by the limitations and disadvantages of the related art.

In one embodiment, there is provided an image forming apparatus that includes a latent image carrier configured to carry a latent image; a latent image writer configured to write the latent image on the latent image carrier; a developing unit including a toner carrier configured to carry toner, the toner carrier including a first electrode and a second electrode arranged along a surface thereof, the first electrode and the second electrode being insulated from each other via an insulator member, and a voltage applying unit configured to apply voltages to the first electrode and the second electrode such that first electric fields formed by a potential difference between the first electrode and the second electrode cause the toner to hop from the toner carrier to the latent image carrier to attach the hopping toner to the latent image formed on the latent image carrier to develop a toner image on the latent image carrier; and a transfer unit configured to transfer the toner image developed on the latent image carrier to a transferring member. In the image forming apparatus, when alternating voltages having a same phase and a same amplitude and capable of forming second electric fields between the latent image carrier and the toner carrier to cause the toner to hop from the toner carrier toward the latent image carrier are applied to the first electrode and the second electrode in a toner discharge mode, the toner is discharged from the toner carrier to the latent image carrier in the toner discharge mode.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

First Embodiment

In the following, embodiments of the present invention will be described with reference to the accompanying drawings.

An electrophotographic image forming apparatus according to a first embodiment is described. A configuration and operations of the image forming apparatus according to the first embodiment are described.

Figure 2:
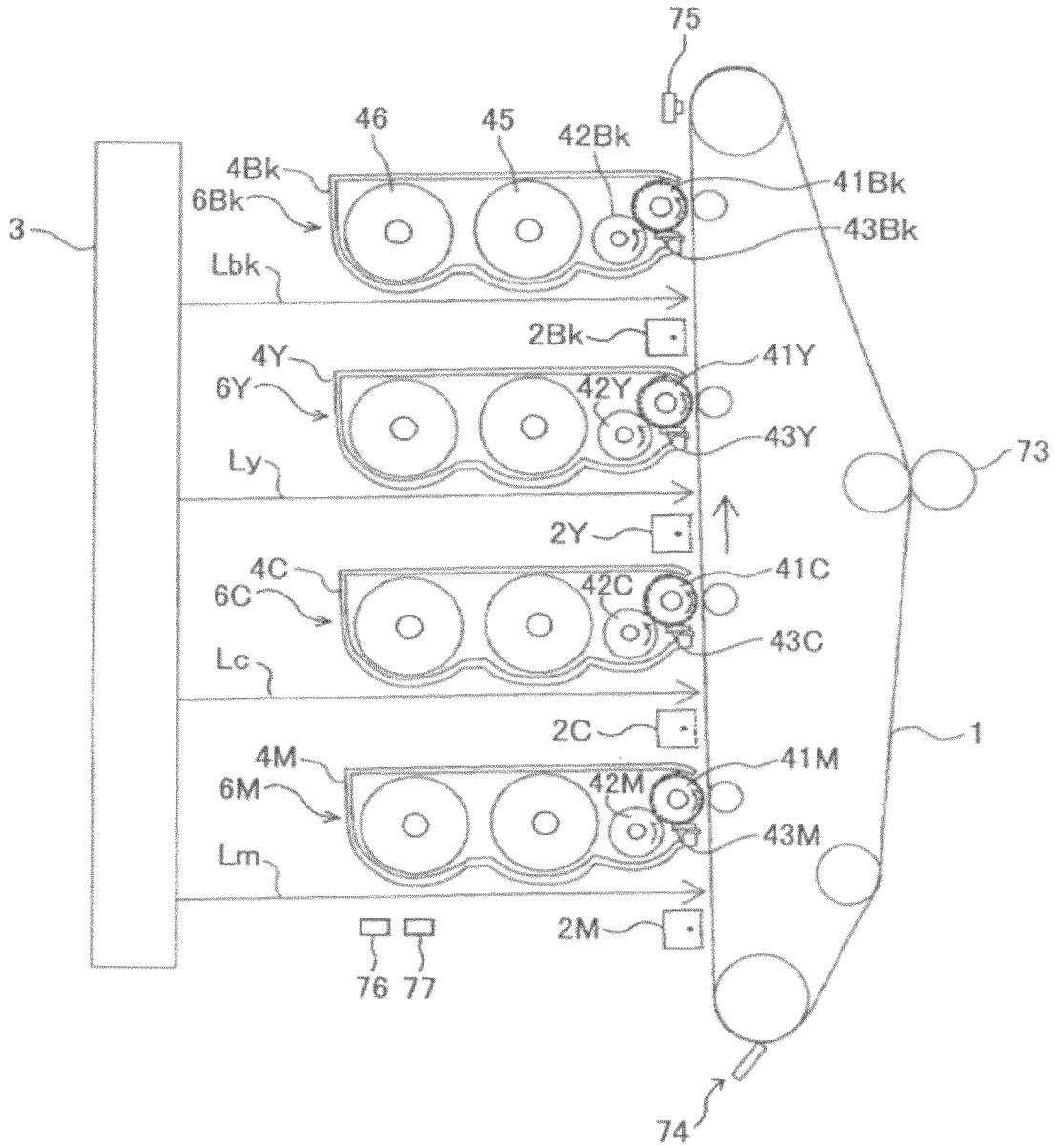
FIG. 2 is a schematic configuration diagram illustrating a major part of the image forming apparatus according to the embodiment.

FIG. 2 is a schematic diagram illustrating a major part of the image forming apparatus according to the first embodiment. The image forming apparatus according to the first embodiment includes plural developing devices such that toner images of different colors are superimposed on a surface of a belt-type photoreceptor 1 utilized as a latent image carrier to form a multi-color image. The belt-type photoreceptor 1 is looped over plural rollers such that the belt-type photoreceptor 1 is elongated in a vertical direction rather than in a horizontal direction in FIG. 2. The belt-type photoreceptor 1 is rotationally driven by a not-illustrated driver such that the belt-type photoreceptor 1 travels in a clockwise direction in FIG. 2. The tensioned surface of the photoreceptor 1 on the left-hand side in FIG. 2 (hereinafter called a "left-side tightened surface") is extended in an approximately vertical direction.

As illustrated in FIG. 2, on the further left-hand side of the left-side tightened surface of the photoreceptor 1, four process units 6M, 6C, 6Y and 6Bk configured to form plural color images such as magenta (M), cyan (C), yellow (Y), and black (Bk) images are arranged in the vertical direction as respective image forming units such that the process units 6M, 6C, 6Y and 6Bk face the photoreceptor 1. The four process units 6M, 6C, 6Y and 6Bk respectively include developing devices 4M, 4C, 4Y and 4Bk, chargers 2M, 2C, 2Y and 2Bk configured to uniformly charge the photoreceptor 1, and not-illustrated static eliminators as respective units supported by a not-illustrated common supporter. With this configuration, the developing devices 4M, 4C, 4Y and 4Bk, the chargers 2M, 2C, 2Y and 2Bk and the static eliminators are removed as the respective process units 6M, 6C, 6Y and 6Bk when a user desires to replace the corresponding components with new ones.

Further, in FIG. 2, an optical writer 3 is provided as a latent image forming unit. The optical writer 3 is configured to emit exposure beams Lm, Lc, Ly and Lbk of respective colors toward the photoreceptor 1 through respective gaps between the developing devices 4M, 4C, 4Y and 4Bk and the chargers 2M, 2C, 2Y and 2Bk arranged in the four process units 6M, 6C, 6Y and 6Bk.

Moreover, the image forming apparatus according to the first embodiment further includes a temperature sensor 76 as a temperature detector configured to detect the temperature inside the image forming apparatus, a humidity sensor 77 as a humidity detector configured to detect humidity inside the image forming apparatus, a transfer roller 73 as a transfer unit configured to transfer an image from the photoreceptor 1 onto a recording material, and a cleaner device 74 as a cleaning unit configured to clean the surface of the photoreceptor 1. In addition, the image forming apparatus according to the first embodiment further includes not-illustrated paper feeder and fixing device parts. Note that hereinafter, generically, the process units 6M, 6C, 6Y and 6Bk may be called "process unit 6", the developing devices 4M, 4C, 4Y and 4Bk may be called "developing device 4", the chargers 2M, 2C, 2Y and 2Bk may be called "charger 2", and the exposure beams Lm, Lc, Ly and Lbk may be called "exposure beam L" for convenience in illustration.

Figure 3:
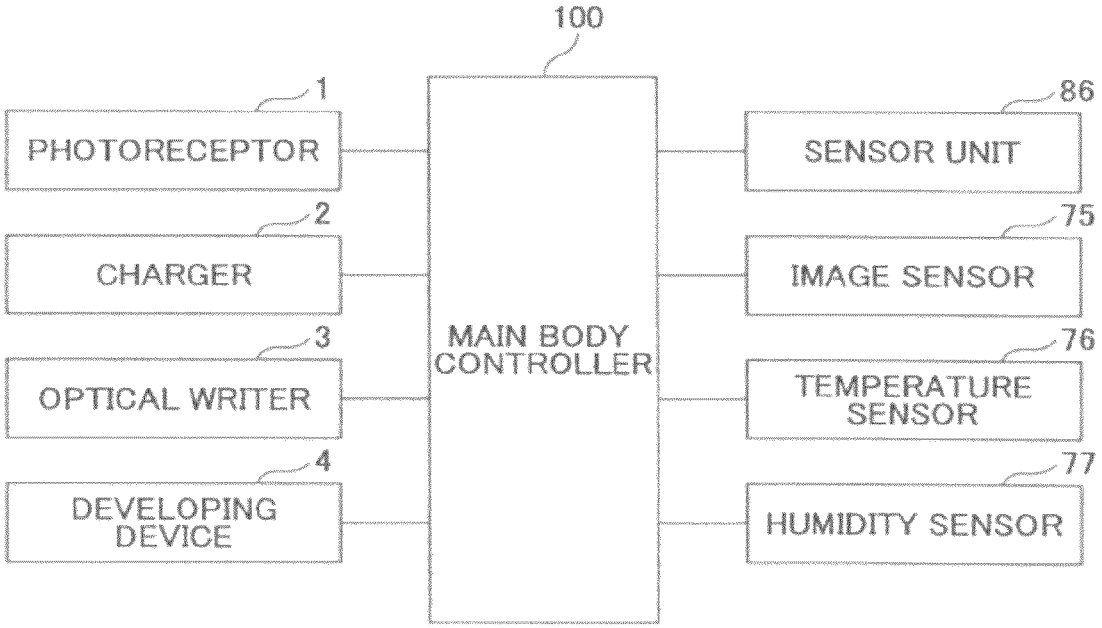
FIG. 3 is a block diagram illustrating a configuration example of the major part of the image forming apparatus.

FIG. 3 is a block diagram illustrating a configuration example of a major part of the image forming apparatus. The image forming apparatus includes a main body controller 100 having a CPU, memories and the like. The main body controller 100 controls the photoreceptor 1, the charger 2, the optical writer 3, the developing device 4, and the like, based on signals supplied from an image sensor 75, the temperature sensor 76, the humidity sensor 77, and a sensor unit 86, and the like arranged inside the image forming apparatus. Note that the main body controller 100 further controls other units such as the paper feeder or the fixing device also arranged inside the image forming apparatus.

The photoreceptor 1 is rotatably driven in a direction illustrated by an arrow in FIG. 2. For example, in FIG. 2, the photoreceptor 1 is uniformly charged by the magenta charger 2M of the magenta process unit 6M, and subsequently exposed with the exposure beam Lm that is modulated based on magenta image data by the optical writer 3 so as to form a magenta electrostatic latent image. The electrostatic latent image is then developed by the magenta developing device 4M so as to form a magenta toner image. Thereafter, the not-illustrated static eliminator discharges the photoreceptor 1.

Next, the photoreceptor 1 is uniformly charged by the cyan charger 2C of the cyan process unit 6C, and subsequently exposed with the exposure beam Lc that is modulated based on cyan image data by the optical writer 3 so as to form a cyan electrostatic latent image. The electrostatic latent image is then developed by the cyan developing device 4C so as to form a cyan toner image superimposed over the magenta toner image. Thereafter, the not-illustrated static eliminator discharges the photoreceptor 1.

Further, the photoreceptor 1 is uniformly charged by the yellow charger 2Y of the yellow process unit 6Y, and subsequently exposed with the exposure beam Ly that is modulated based on yellow image data by the optical writer 3 so as to form a yellow electrostatic latent image. The electrostatic latent image is then developed by the yellow developing device 4Y so as to form a yellow toner image superimposed over the cyan and magenta toner images. Thereafter, the not-illustrated static eliminator discharges the photoreceptor 1.

Finally, the photoreceptor 1 is uniformly charged by the black charger 2Bk of the black process unit 6Bk, and subsequently exposed with the exposure beam Lbk that is modulated based on black image data by the optical writer 3 so as to form a black electrostatic latent image. The electrostatic latent image is then developed by the black developing device 4Bk so as to form a black toner image superimposed over the yellow, cyan and magenta toner images.

Meanwhile, the recording material such as a recording sheet is fed by the paper feeder (not illustrated), on which a full-color image formed on the surface of the photoreceptor 1 is transferred by the transfer roller 73 utilized as the transfer unit configured to apply a transfer bias to the recording material. The full-color image formed on the recording material is then fixed by the fixing device (not illustrated) and the recording material on which the full-color image is fixed is then discharged from the image forming apparatus. After having transferred the full-color image to the recording material, residual toner and the like remaining on the surface of the photoreceptor 1 are removed by the cleaner device 74 utilized as the cleaning unit.

In the image forming apparatus having the above configuration, since the four color images are recorded on the surface of the same photoreceptor 1, positional deviations in superimposing the four color images scarcely occur, compared to a generally used tandem type image forming apparatus including four photoreceptors from which different color images are superimposed to form a full-color image.

Note that the configuration of the image forming apparatus according to the first embodiment may be applied to the general tandem type image forming apparatus or to other types of the image forming apparatus.

Next, the developing device 4 utilizing the hopping type developing system adopted by the image forming apparatus according to the first embodiment is described.

Note that the developing devices 4M, 4C, 4Y and 4Bk have the same configurations and exhibit the same operations except that they contain toner of different colors, and thus the generic term "developing device 4" is used in the following illustration when appropriate.

Figure 4:
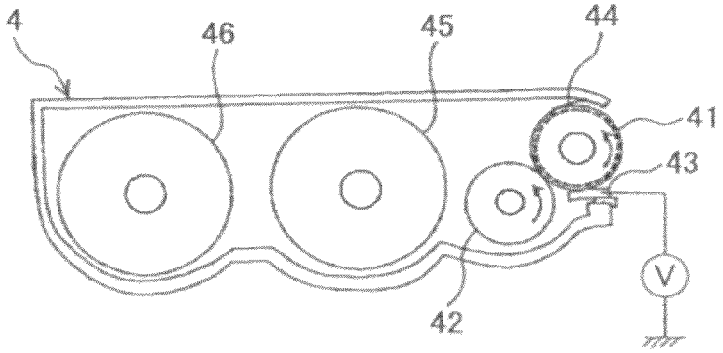
FIG. 4 is a schematic configuration diagram illustrating a developing device utilizing a flaring developing system in the image forming apparatus according to the embodiment.
Figure 5:
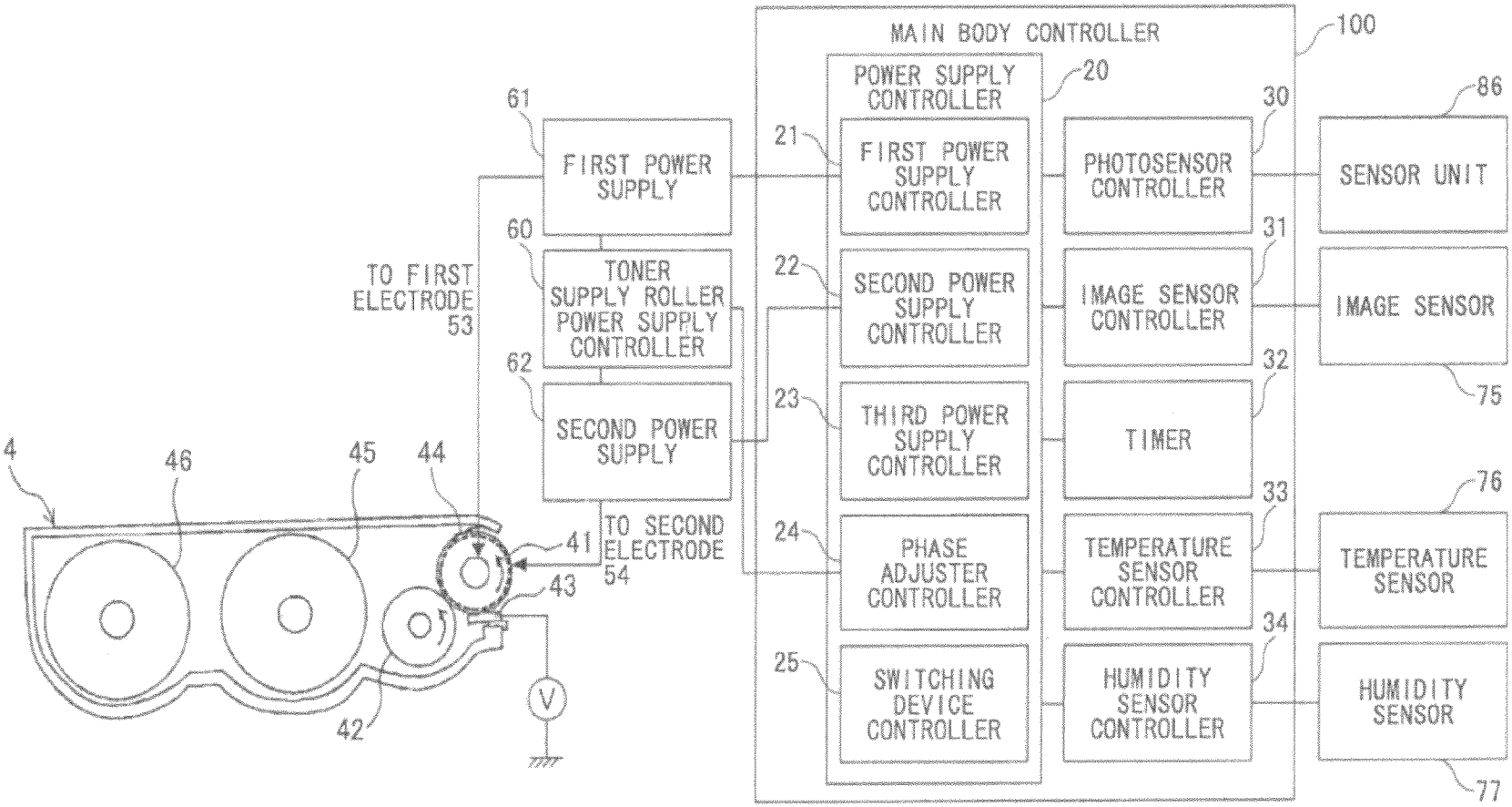
FIG. 5 is a control block diagram illustrating components associated with power supply control of the developing device controlled by a main body controller of the image forming apparatus.

FIG. 4 is a schematic configuration diagram illustrating the developing device 4 utilizing a flaring developing system in the image forming apparatus according to the embodiment. FIG. 5 is a control block diagram illustrating components associated with power supply control of the developing device 4 controlled by the main body controller 100 of the image forming apparatus.

The developing device 4 includes a toner carrier roller 41 utilized as a toner carrier, a toner supply roller 42 utilized as a toner supply member configured to supply toner to the toner carrier roller 41, a regulator blade 43 utilized as a toner regulator member configured to regulate a thickness of a toner layer, an entrance sealer 44, a first transfer screw 45 configured to be rotationally driven in a clockwise direction in FIG. 4, and a second transfer screw 46 configured to be rotationally driven in a counter-clockwise direction in FIG. 4. In FIG. 4, the second transfer screw 46 is rotationally driven such that the toner is transferred from a front side to a rear side of the developing device 4. The toner transferred near the end of the rear side of the developing device 4 is transferred toward the first transfer screw 45 side. Subsequently, the first transfer screw 45 is rotationally driven such that the toner is transferred from the rear side to the front side of the developing device 4. Part of the toner transferred by the first screw 45 is moved to the toner supply roller 42 side and is then carried on the surface of the toner supply roller 42. The toner carried on the surface of the toner supply roller 42 is carried to a contact position (hereinafter called a "toner supply position") between the surface of the toner supply roller 42 and a outer outer circumferential surface of the toner carrier roller 41 along with the movement of the toner supply roller 42 rotationally driven in the counter-clockwise direction in FIG. 4.

At the toner supply position, the surface of the toner supply roller 42 and the outer circumferential surface of the toner carrier roller 41 move in opposite directions (counter directions) to each other. Note that the toner supply roller 42 and toner carrier roller 41 rotate in the same direction as illustrated in FIG. 4. Thus, the toner on the surface of the toner supply roller 42 carried to the toner supply position is rubbed off on the outer circumferential surface of the toner carrier roller 41. The toner on the surface of the toner supply roller 42 is transferred onto the outer circumferential surface of the toner carrier roller 41 in this fashion. As will be described later, in the image forming apparatus according to the first embodiment, the outer circumferential surface of the toner carrier roller 41 is formed of an insulator material that may give the normal charging polarity (a minus polarity in this embodiment) to toner due to friction against the outer circumferential surface of the toner carrier roller 41. Accordingly, the toner charge necessary for allowing the toner to hop may be stably acquired in addition to the charge given by the regulating part of the regulator blade 43.

As illustrated in FIG. 4, the outer circumferential surface of the toner carrier roller 41 on which the toner is supplied is partially exposed from an opening of a casing of the developing device 4. This exposed part of the outer circumferential surface of the toner carrier roller 41 faces the photoreceptor 1 via a gap of several tens to several hundred μm. A facing region of the toner carrier roller 41 and the photoreceptor 1 is a developing region of the image forming apparatus according to the first embodiment.

The toner supplied on the surface of the toner carrier roller 41 is transferred by the regulator blade 43 to the regulating part along with the movement the rotationally driven toner carrier roller 41 such that the regulator blade 43 regulates the amount of toner on the surface of the toner carrier roller 41. At this moment, the toner is charged to the normal charging polarity due to friction against the regulator blade 43 or the outer circumferential surface of the toner carrier roller 41. The charged toner having passed through the regulating part of the regulator blade 43 is then transferred from the toner supply position to the developing region along with the rotational movement of the toner carrier roller 41 while hopping on the surface of the toner carrier roller 41 for a later described reason. The toner transferred to the developing region is attached to the electrostatic latent image on the surface of the photoreceptor 1 due to the development field generated between the toner carrier roller 41 and the electrostatic latent image on the photoreceptor 1. The development of an image is thus conducted. The hopping toner not utilized for the development of the image is further transferred to the toner supply position along with the rotational movement of the toner carrier roller 41. The unutilized hopping toner is rubbed off (removed) from the toner carrier roller 41 by the toner supply roller 42 before being placed in the toner supply position. The removed toner is then returned into the casing of the developing device 4 for later reuse.

Note that the toner carried on the toner carrier roller 41 is hopping when microscopically viewed, but looks like flares when macroscopically viewed. In this embodiment, the toner in such a condition is called the "toner flaring". Further, the developing system utilizing the toner flaring is called a "flaring developing" system. Note that the term "flare" derives from a solar flare since the macroscopically viewed hopping toner is analogous to the solar flare.

Figure 6:
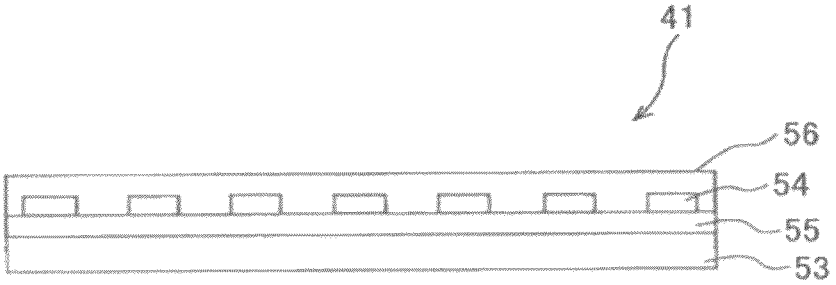
FIG. 6 is a partial cross-sectional diagram schematically illustrating a cross section of a toner carrier roller cut along its surface orthogonal to a rotational axis of the toner carrier roller.

Next, the configuration of the toner carrier roller 41 utilized in the first embodiment is specifically described. FIG. 6 is a partial cross-sectional diagram schematically illustrating a cross section of the toner carrier roller 41 cut along its surface orthogonal to a rotational axis of the toner carrier roller 41. Further, FIG. 7A is a plan diagram illustrating the toner carrier roller 41 when being rolled out, and FIG. 7B is a perspective diagram schematically illustrating a relationship between the toner carrier roller 41 and the first and the second power supplies 61 and 62.

Figure 7A:
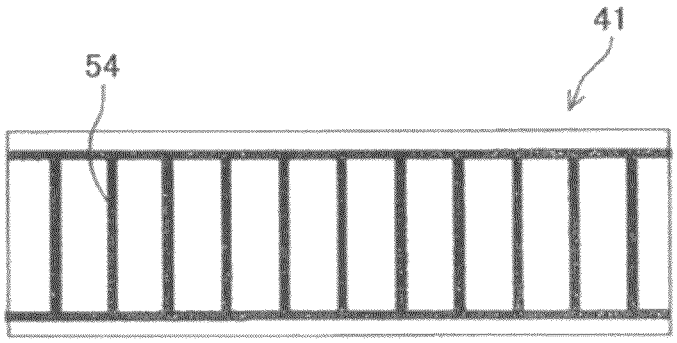
FIG. 7A is a plan diagram illustrating the toner carrier roller when the toner carrier roller is rolled out.
Figure 7B:
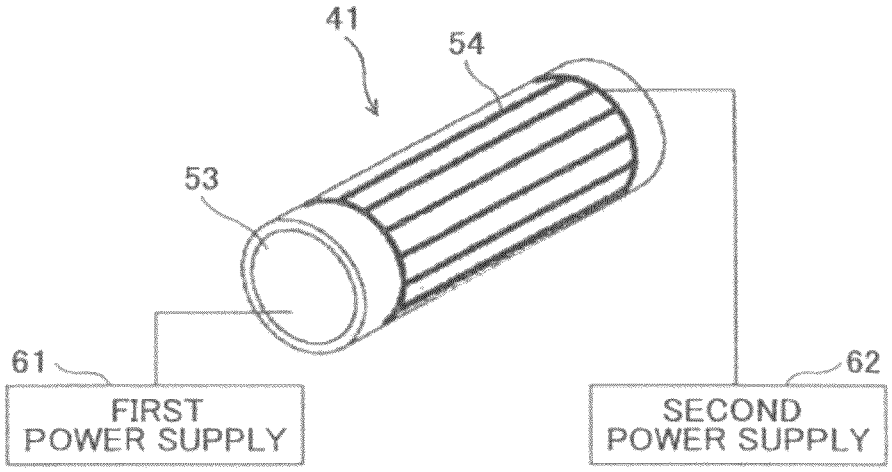
FIG. 7B is a perspective diagram schematically illustrating a relationship between the toner carrier roller and the first and the second power supplies.

As illustrated in FIGS. 7A and 7B, the toner carrier roller 41 utilized in the first embodiment is formed of a tubular roller member (i.e., long, round, and hollow in shape). The toner carrier roller 41 includes a first electrode 53 arranged at an innermost circumferential position as an innermost circumferential electrode member or inner circumferential electrode member to which a first voltage is applied, and a comb-like (ladder-like) second electrode 54 arranged at an outermost circumferential position as an outermost circumferential electrode member to which a second voltage differing from the first voltage is applied. The toner carrier roller 41 further includes an insulator layer (see FIGS. 15 and 16) between the first electrode 53 and the second electrode 54 to insulate the first electrode 53 from the second electrode 54. The toner carrier roller 41 further includes a surface layer 56 (see FIGS. 15 and 16) to cover the outer circumferential surface of the toner carrier roller 41. That is, the toner carrier roller 41 has a four-layer structure including the first electrode 53, the insulator layer 55, the second electrode 54 and surface layer 56 arranged in the order from the innermost circumferential surface to the outermost circumferential surface (see FIGS. 15 and 16).

The first electrode 53 is a metallic roller formed of a conductive material such as stainless steel (SUS) or aluminum in a cylindrical shape. Note that the first electrode 53 also serves as a substrate of the toner carrier roller 41. The first electrode 53 may also be formed of a conductive metallic layer made of aluminum or copper on a surface of a resin roller made of polyacetal (POM) or polycarbonate (PC). The method for forming such a conductive layer may include metallic plating, vapor deposition, and adhering metallic film on the surface of the roller.

The outer circumferential surface of the first electrode 53 is covered with the insulator layer 55. In the first embodiment, the insulator layer 55 is made of polycarbonate, melamine alkyd, or the like. Further, in the first embodiment, the thickness of the insulator layer 55 is preferably in a range of 3 to 50 μm. The insulator layer 55 having the thickness less than 3 μm may not sufficiently maintain the insulating property between the first electrode 53 and the second electrode 54, which may result in the current leakage between the first electrode 53 and the second electrode 54. On the other hand, the insulator layer 55 having the thickness greater than 50 μm may inhibit the electric fields formed between the first electrode 53 and the second electrode 54 from being formed outside the surface layer 56, which may not allow strong hopping electric fields to be formed outside the surface layer 56.

Note that the "hopping electric fields" indicate the electric fields formed between the first electrode 53 and the second electrode 54 which cause the toner to hop or exhibit hopping behavior between the two electrodes.

In the first embodiment, the insulator layer 55 formed of melamine resin has a thickness of 20 μm. The insulator layer 55 may be formed by spraying or dipping such that the insulator layer 55 is formed with a uniform thickness on the first electrode 53.

The second electrode 54 is formed over the insulator layer 55. In the first embodiment, the second electrode 54 is made of metal such as aluminum, copper or silver. Various methods may be employed for forming the comb-like (ladder-like) second electrode 54. For example, the comb-like (ladder-like) second electrode 54 may be formed by forming a metallic film on the insulator layer 55 by plating or vacuum deposition and then forming the metallic film in the comb-like (ladder-like) shape by the photoresist etching. Alternatively, the comb-like (ladder-like) second electrode 54 may be formed by attaching conductive paste on the insulator layer 55 by inkjet printing or screen printing.

The outer circumferential surfaces of the second electrode 54 and the insulator layer 55 are covered with the surface layer 56 having the insulating property. The toner is charged by being frictionally attached to the surface layer 56 while the toner repeatedly exhibits hopping behavior on the surface layer 56. In order to allow the toner to be charged to the normal charging polarity (a minus polarity in this embodiment), silicone, nylon (registered trade mark), urethane, melamine alkyd, polycarbonate and the like may be used as a material for the surface layer 56. In the first embodiment, polycarbonate is used as the material for the surface layer 56. Further, since the surface layer 56 serves as a protector to protect the second electrode 54, the thickness of the surface layer is preferably in a range of 3 to 40 μm. The surface layer 56 having the thickness less than 3 μm may result in breakage due to aging, which may expose the second electrode. As a result, the current may be leaked via the toner carried on the toner carrier roller 41 or other components that may come into contact with the toner carrier roller 41. On the other hand, the insulator layer 55 having the thickness greater than 40 μm may inhibit the electric fields formed between the first electrode 53 and the second electrode 54 from being formed outside the surface layer 56, which may not allow strong hopping electric fields to be formed outside the surface layer 56. In the first embodiment, the surface layer 56 has a thickness of 20 μm. The surface layer may be formed by spraying or dipping in the manner similar to that used for the insulator layer 55.

In the first embodiment, the electric fields formed between the first electrode 53 and the second electrode 54, that is, the electric fields formed over portions of the first electrode 53 that have no facing counterpart portions of the second electrode 54 are formed outside of the surface layer 56, which may cause the toner on the toner carrier roller 41 to exhibit hopping behavior. As a result, the hopping toner may appear to be flared. Note that the toner in a flaring state may also be called the "toner flaring" and the toner in a non-flaring state may also be called the "non-toner flaring". In this case, the toner on the toner carrier roller 41 may be hopping in a reciprocating manner between portions of the surface layer 56 facing the first electrode 53 via the insulator layer 55 and adjacent portions of the surface layer 56 facing the second electrode 54.

In order to cause the toner to be flared with stability, substantially strong hopping electric fields may need to be formed. It may be necessary to generate a significantly large potential difference between the first electrode 53 and the second electrode 54 for forming such strong hopping electric fields. However, in order to generate such a significantly large potential difference between the first electrode 53 and the second electrode 54, the first electrode 53 may need to be efficiently insulated from the second electrode 54 with stability to prevent the current from leaking via intervals between the first electrode 53 and the second electrode 54.

Note that if two different types of electrodes are concentrically formed in a comb-like (ladder-like) shape on the cylindrical resin substrate as the first electrode and the second electrode, and narrow pointed teeth along one side of the first electrode are alternately arranged between narrow pointed teeth along the other side of the second electrode, the insulating property between the two electrodes may be drastically reduced due to structural defects in forming the electrodes, which may induce the current leakage from the intervals between the two electrodes. More specifically, for example, if the electrodes are formed by etching, portions of the metallic film to be removed may remain, or if the electrodes are formed by inkjet printing or screen printing, the conductive paste may remain between the two electrodes. In either of the above cases, the current leakage may occur between the two electrodes and thus appropriate hopping electric fields may not be formed. Further, in considering the electrode structure of the above two cases, even if two comb-like (ladder-like) electrodes are formed on the resin surface of the roller with high precision, the outer circumferential surfaces of the two comb-like (ladder-like) electrodes are covered with the insulator material in the intervals between the teeth array of the two electrodes. However, since interfaces of the resin surface of the roller and the insulator material are formed between the two electrodes, the current may easily leak through the interfaces. Thus, when a relatively high voltage is applied to the electrodes having this structure, the insulating property between the two electrodes may be drastically degraded.

In the first embodiment, the insulator layer 55 is formed on the first electrode 53, and the comb-like (ladder-like) second electrode 54 is formed on the insulator layer 55. Accordingly, there are no interfaces that may cause the current leakage from the intervals between the two electrodes. Further, in the first embodiment, the conductive material that is a possible factor of the current leakage may hardly intrude in the intervals between the two electrodes in forming the toner carrier roller 41. As described above, in the first embodiment, the first electrode 53 may be effectively insulated from the second electrode 54 with stability. Accordingly, even if a relatively high voltage is applied to the electrodes, the current leakage may be effectively prevented.

Figure 8A:
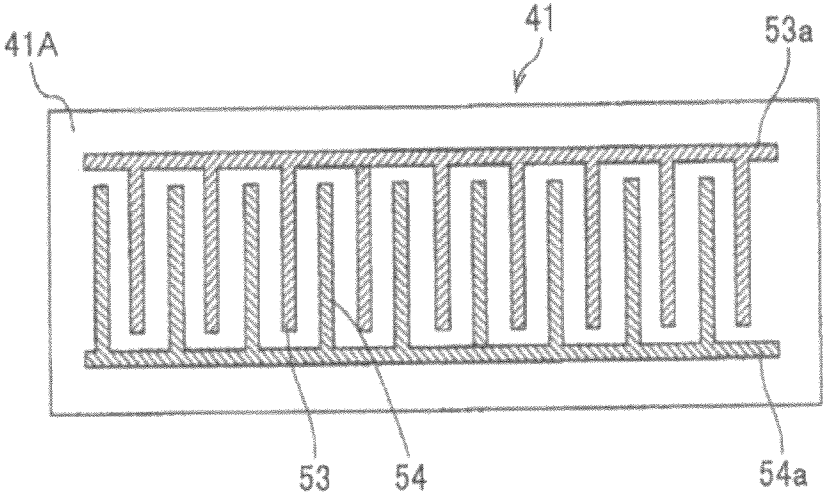
FIG. 8A is a schematic plan diagram illustrating the toner carrier roller when the toner carrier roller is rolled out.
Figure 8B:
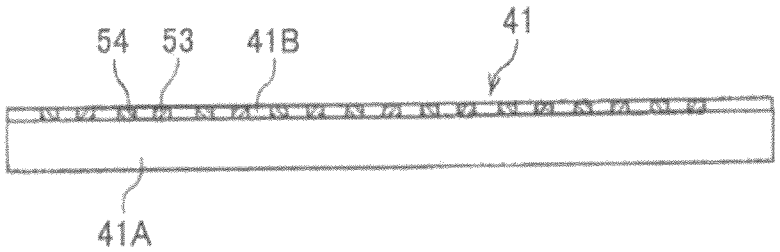
FIG. 8B is a schematic cross-sectional diagram illustrating the toner carrier roller.

FIG. 8A is a schematic plan diagram illustrating the toner carrier roller 41 when the toner carrier roller 41 is rolled out, and FIG. 8B is a schematic cross-sectional diagram illustrating the toner carrier roller 41. The first embodiment may also be applied to the configuration illustrated in FIGS. 8A and 8B, where the two different types of comb-like (ladder-like) electrodes are concentrically formed on the resin substrate as the first electrode and the second electrode, and narrow pointed teeth along one side of the first electrode are alternately arranged between narrow pointed teeth along the other side of the second electrode. The toner carrier roller 41 illustrated in FIGS. 8A and 8B includes an insulator substrate 41A, comb-like (ladder-like) first and second electrodes 43 and 54 formed on a surface of the insulator substrate 41A, and a surface protective layer 41B formed over the first and second comb-like (ladder-like) electrodes 53 and 54. The first and the second electrodes 53 and 54 are arranged at fine pitches in parallel with each other in a direction orthogonal to a toner transfer direction. The first and the second electrodes 53 and 54 are respectively connected to the first power supply 61 and the second power supply 62 (see FIG. 5) via a bus line 53*a* and a bus line 54*a* provided one at each side.

Further, the electrode width of the second electrode 54 (i.e., each narrow pointed tooth) is preferably in a range of 10 to 120 μm. The second electrode 54 having the electrode width less than 10 μm may result in the breakage of the electrode due to a too-fine structure. On the other hand, the second electrode 54 having the electrode width greater than 10 μm may result in lowering the voltage applied to part of the second electrode 54 arranged far from the power supply position, which may inhibit stable and effective activation of the toner hopping. In the first embodiment, the power supply position is provided at both ends on the outer circumferential surface of the toner carrier roller 41 in the axial direction. Accordingly, the second electrode 54 having the electrode width greater than 12 μm may result in forming the hopping electric fields in the central portion of the toner carrier roller 41 in the axial direction that are comparatively lower than the hopping electric fields in both ends of the toner carrier roller 41 in the axial direction. As a result, the toner carried in the central portion of the toner carrier roller 41 in the axial direction may not be activated to exhibit stable and effective hopping behavior.

Further, the electrode pitch of the second electrode 54 (i.e., intervals between narrow pointed teeth) is preferably the same width as the electrode width or wider than the electrode width. The electrode pitch of the second electrode 54 having the electrode pitch narrower than the electrode width may result in conversion of a large amount of lines of electric force on the second electrode 54 before allowing the lines of electric force to be outputted outside the surface layer 56. As a result, the hopping electric fields formed outside the surface layer 56 may be weakened. On the other hand, the second electrode 54 having the electrode pitch wider than the electrode width may result in forming weak hopping electric fields in the intervals between the electrodes. In the first embodiment, the preferable electrode pitch may be wider than the electrode width, and equal to or less than five times of the electrode width. In the first embodiment, the electrode width and the electrode pitch of the second electrode 54 are both set at 80 μm.

Further, in the first embodiment, the electrode pitch of the second electrode 54 is constant across the circumferential direction of the toner carrier roller 41. The constant electrode pitch arranged across the circumferential direction of the toner carrier roller 41 may result in generation of approximately constant hopping electric fields, which are generated between the first and the second electrodes, across the circumferential direction of the toner carrier roller 41. Thus, uniform toner hopping across the circumferential direction of the toner carrier roller 41 may be implemented in the developing region, resulting in uniform image development.

Next, descriptions are given of the voltages applied to the first electrode 53 and the second electrode 54. The first electrode 53 and the second electrode 54 formed on the toner carrier roller 41 are supplied with a first voltage and a second voltage by the first power supply 61 and the second power supply 62, respectively (see FIG. 5) utilized as pulsed power supplies. The voltages applied by the first power supply 61 and the second power supply 62 are controlled by a first power supply controller 21 and a second power supply controller 22 of the main body controller 100 illustrated in FIG. 5. A preferable waveform of the first voltage and the second voltage applied by the first power supply 61 and the second power supply 62 may be a rectangular wave. However, the waveform of the first voltage and the second voltage applied by the first power supply 61 and the second power supply 62 may not be limited to the rectangular wave, and the waveform of the first voltage and the second voltage may be a sine wave or a triangular wave. Further, the electrodes for generating the hopping electric fields constitute a two-phase electrode structure formed of the first electrode 53 and the second electrode 54 in the first embodiment, and the first electrode 53 and the second electrode 54 are supplied with first and second voltages having a mutual phase difference n.

Figure 9:
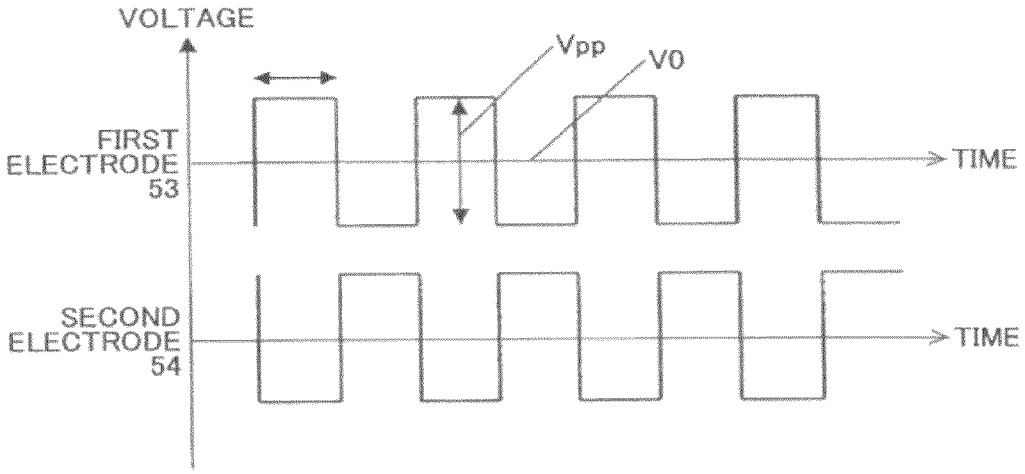
FIG. 9 is a graph illustrating an example of a first voltage and a second voltage respectively applied to the first electrode and the second electrode.

FIG. 9 is a graph illustrating an example of the first voltage and the second voltage respectively applied to the first electrode 53 and the second electrode 54.

In the first embodiment, the first and the second voltages include rectangular waves, and the first and the second voltages applied to the first and the second electrodes 53 and 54 have a phase difference n from each other (i.e., peak-to-peak voltage Vpp). Thus, there is a constant potential difference Vpp between the first electrode 53 and the second electrode 54. The potential difference Vpp generates electric fields between the first and the second electrodes 53 and 54, parts of which form the hopping electric fields outside the surface layer 56 to cause the toner to exhibit hopping behavior on the surface layer 56. In the first embodiment, the preferable potential difference Vpp may be in a range of 100 to 1000 V. The potential difference Vpp less than 100 V may result in failure in forming a satisfactory amount of hopping electric fields over the surface layer 56 and the toner may not stably exhibit hopping behavior over the surface layer 56. On the other hand, the potential difference Vpp greater than 100 V may result in too high potential difference between the first and the second electrodes 53 and 54, and the current leakage may occur due to aging of the electrodes. In the first embodiment, the potential difference Vpp is set at 500 V.

Further, in the first embodiment, the central value V0 of the first voltage and the second voltage may be set between a potential of an image-formed portion (potential of a latent image-formed portion) and a potential of a non-image formed portion (potential of a bare surface potion), and may be appropriately changed based on the developing condition.

In the first embodiment, a preferable frequency f of the first voltage and that of the second voltage may be in a range of 0.1 to 10 kHz. The first voltage or the second voltage having the frequency f lower than 0.1 kHz may prevent the toner hopping behavior from catching up with the developing speed. On the other hand, the first voltage or the second voltage having the frequency f higher than 10 kHz may cause the toner hopping to fail to follow the switchover of the electric fields and the toner may not stably exhibit hopping behavior over the surface layer 56. In the first embodiment, the frequency f is set at 500 Hz.

Figure 10:
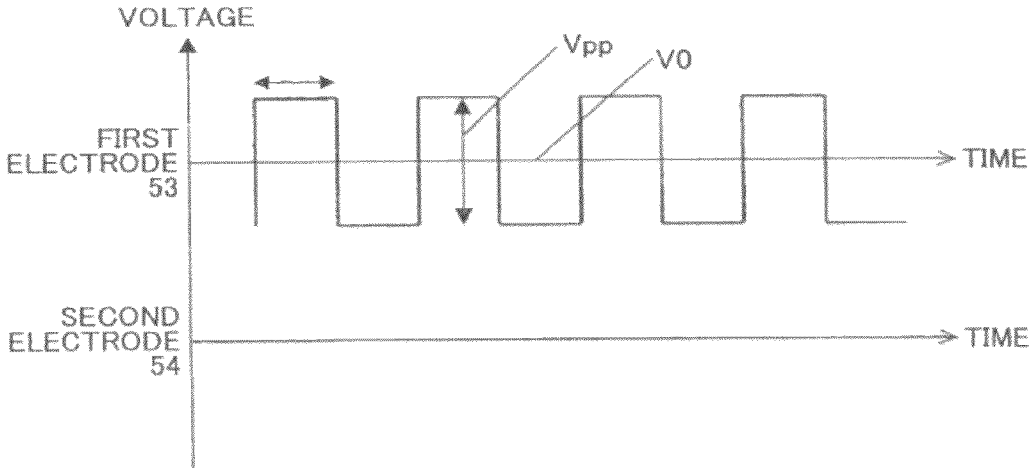
FIG. 10 is a graph illustrating another example of the first voltage and the second voltage respectively applied to the first electrode and the second electrode.

FIG. 10 is a graph illustrating another example of the first voltage and the second voltage respectively applied to the first electrode 53 and the second electrode 54.

In this example, the first electrode 53 is supplied with the same voltage as illustrated in FIG. 9; however, the second electrode 54 is supplied with direct (DC) voltage (f=0). In this case, the potential difference between the first and the second electrodes is Vpp/2. Accordingly, the preferable potential difference Vpp in this example may be in a range of 200 to 1000 V. With this configuration, the potential difference between the first electrode 53 and the second electrode 54 may not need to be considered, and thus the power supply cost may be reduced.

Next, the features of the image forming apparatus according to the first embodiment are described.

Figure 11A:
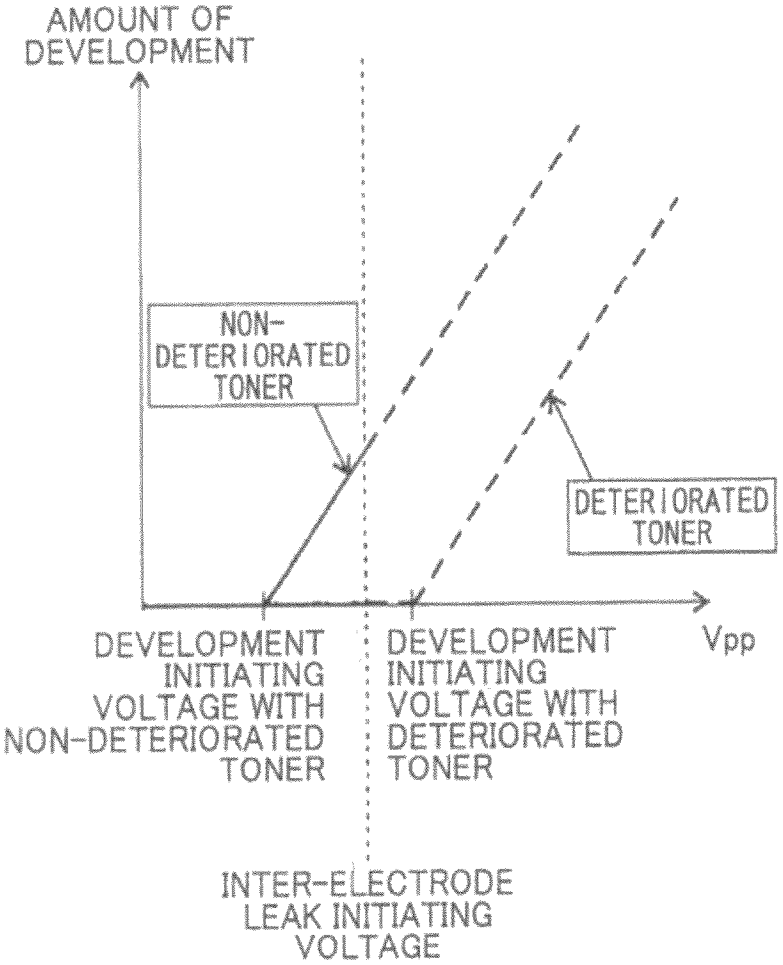
FIG. 11A is a graph illustrating a relationship between the amount of the voltage applied to the first electrode and the second electrode and the amount of development when the voltage applied to the first electrode and the second electrode is temporarily inverted.
Figure 11B:
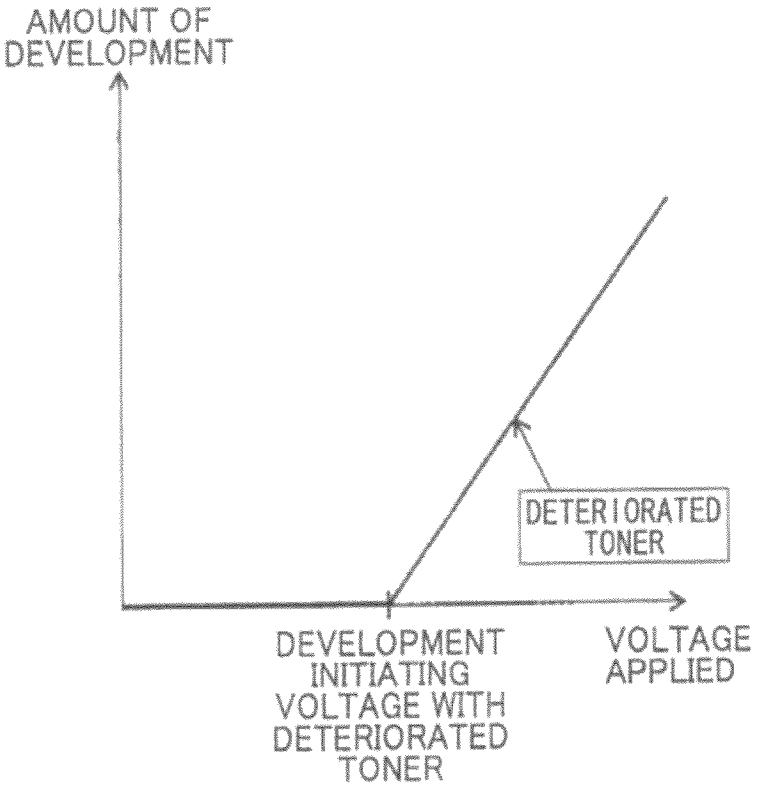
FIG. 11B is a graph illustrating a relationship between the amount of the voltage applied to the first electrode and the second electrode and the amount of development when the voltage applied to the first electrode and the second electrode is unchanged.

In flaring type development conducted by the developing device 4 utilized in the image forming apparatus according to the first embodiment, if the potential difference between the first and the second electrodes 53 and 54 is significantly greater than the inter-electrode leak initiating voltage, the insulator layer 55 may be damaged due to the inter-electrode current leakage as illustrated FIG. 11A. However, if the first and the second electrodes 53 and 54 are supplied with the voltages having the same phase or the same amplitude, no potential difference may occur between the first and the second electrodes 53 and 54, and hence, high voltages may be applied to the first and the second electrodes 53 and 54 as illustrated in FIG. 11B. Accordingly, the potential difference between the photoreceptor 1 or other components and the toner carrier roller 41 may be easily increased.

In the image forming apparatus according to the first embodiment, the voltage obtained by superimposing the alternating voltage on the direct voltage is applied to the first and the second electrodes 53 and 54 while conducting a cleaning and collecting process. When the voltage obtained by superimposing the alternating voltage on the direct voltage is applied to the first and the second electrodes 53 and 54, the first and the second electrodes 53 and 54 have the same phase and amplitude of the alternating voltage. Accordingly, the amplitude of the alternating voltage (Vpp) is greater than the development initiating voltage at the time of toner deterioration (i.e., the voltage applied for initiating the development of the image at a time where the toner is deteriorated).

Further, in the image forming apparatus according to the first embodiment, a toner flaring detector is provided to detect the toner flaring over the toner carrier roller 41 such that a deteriorated toner discharge mode to forcibly discharge the deteriorated toner may be set in the image forming apparatus. With this configuration, if the toner is not flaring, the voltage equal to or greater than the development initiating voltage at the time of toner deterioration may be applied between the photoreceptor 1 and the toner carrier roller 41 to forcibly discharge the deteriorated toner. Herein after such a deteriorated toner discharge mode is simply called a "toner discharge mode".

In the toner discharge mode, the cleaning and collecting process is conducted. In the cleaning and collecting process, the deteriorated toner is discharged onto the photoreceptor 1, and the deteriorated toner on the photoreceptor 1 is removed by the cleaner device 74.

Figure 12A:
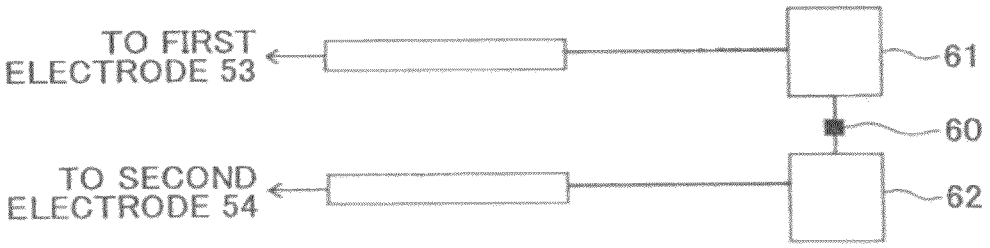
FIG. 12A is a diagram illustrating a configuration of a power supply applying the voltage to the first electrode or the second electrode when the image forming apparatus is in a toner flaring mode.
Figure 12B:
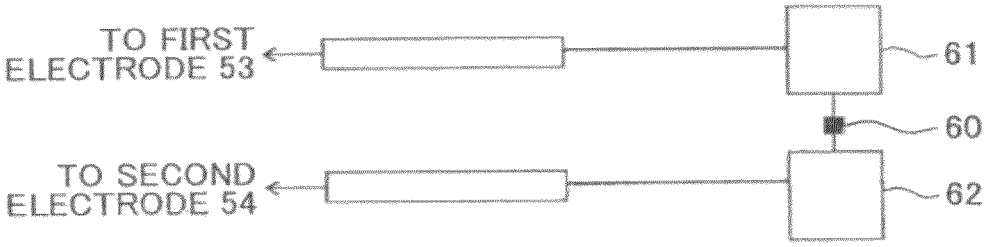
FIG. 12B is a diagram illustrating a configuration of a power supply applying the voltage to the first electrode or the second electrode by utilizing the same power supply as that used in the toner flaring mode when the image forming apparatus is in a toner discharge mode.
Figure 14:
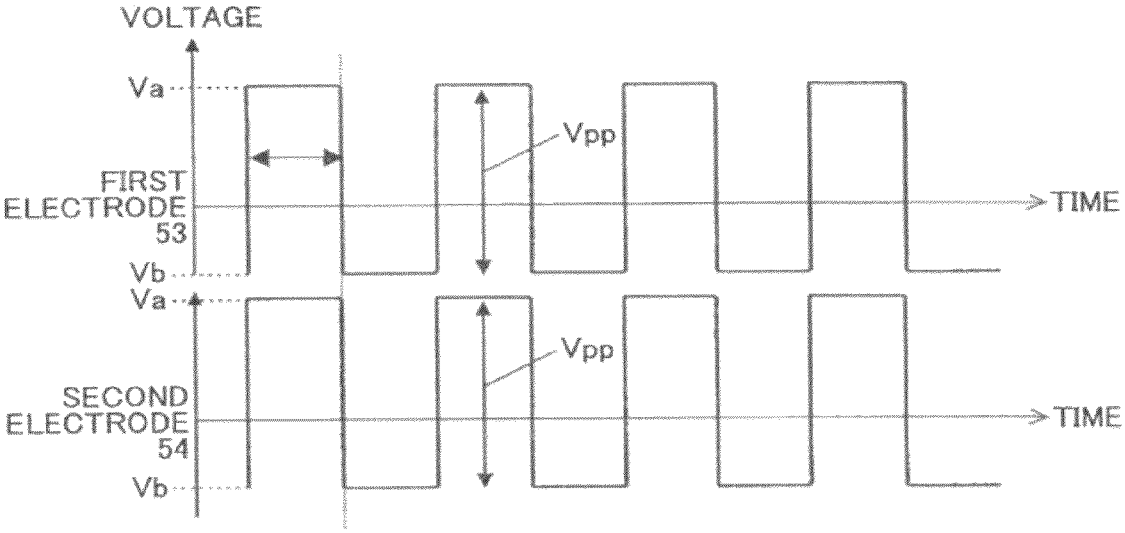
FIG. 14 is a graph illustrating an example where alternating voltages having the same phase and the same amplitude are applied to the first electrode and the second electrode.

More specifically, in the cleaning and collecting process, initially, the photoreceptor 1 is rotationally driven. When the charger 2 uniformly charges the surface of the photoreceptor 1 to −500 V, the optical writer 3 carried out optical scanning over the entire region of the uniformly charged photoreceptor 1 surface to attenuate the charged voltage of the photoreceptor 1 to approximately −50 V. The rotation of the toner carrier roller 41 is stopped until the attenuated part of the photoreceptor 1 surface enters into the developing region along with the rotational movement of the photoreceptor 1. When the attenuated part of the photoreceptor 1 surface enters into the developing region, the rotational driving of the toner carrier roller 41 is initiated. At this moment, the first electrode 53 and the second electrode 54 on the toner carrier roller 41 are supplied with the voltage obtained by superimposing the alternating voltage on the direct voltage via the first power supply 61 and the second power supply 62 as illustrated in FIG. 12B. When the voltage obtained by superimposing the alternating voltage on the direct voltage is applied to the first and the second electrodes 53 and 54, the first and the second electrodes 53 and 54 have the phase and the amplitude of the alternating voltage as illustrated in FIG. 14. Accordingly, the amplitude of the alternating voltage (Vpp) is greater than the development initiating voltage at the time of toner deterioration.

Note that the phase of the alternating voltage applied to the first electrode 53 and the second electrode 54 is adjusted by a phase adjuster 60, which is connected to the first power supply 61 and the second power supply 62, and is controlled by a phase adjuster controller 24 of the main body controller 100 illustrated in FIG. 5. Accordingly, the voltage equal to or greater than the development initiating voltage at the time of toner deterioration may be applied between the photoreceptor 1 and the toner carrier roller 41.

When the above-described voltage is applied to the first electrode 53 and the second electrode 54 on the toner carrier roller 41, electric fields that cause the toner charged with a minus polarity to be electrostatically moved from the toner carrier roller 41 to the photoreceptor 1 may be formed.

Figure 1:
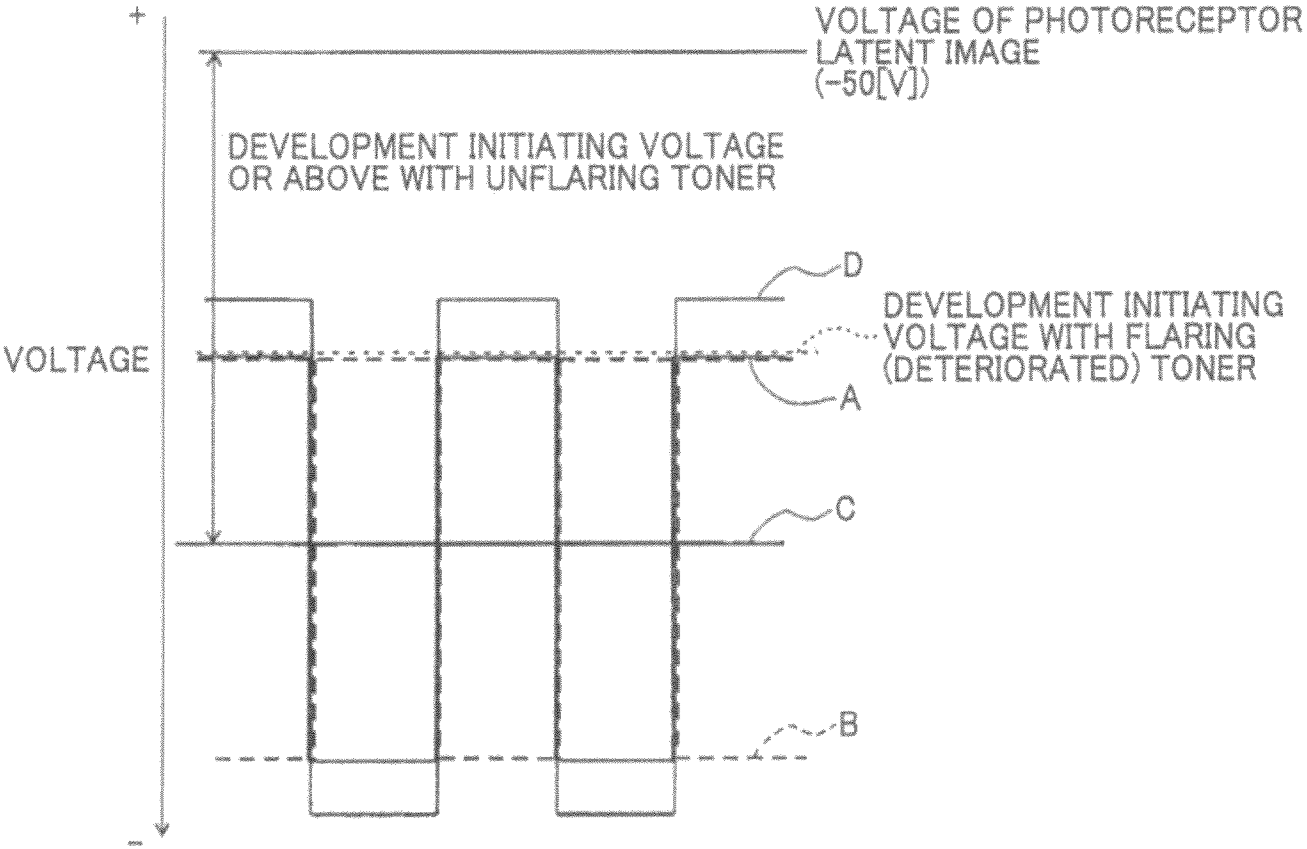
FIG. 1 is a graph illustrating voltages applied to a first electrode and a second electrode when an image forming apparatus according to an embodiment is in a toner flaring mode and a toner discharge mode.
Figure 15:
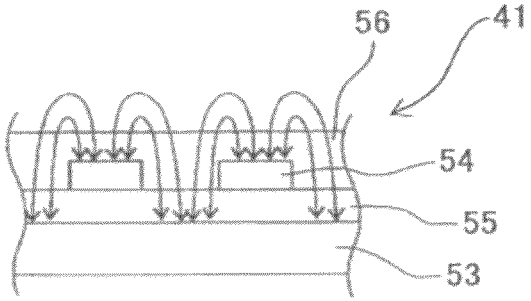
FIG. 15 is a schematic diagram illustrating electric fields that allow the toner to reciprocate between the first electrode and the second electrode while the toner is exhibiting hopping behavior.

Note that when the toner is flaring on the toner carrier roller 41, the respective phases of the alternating voltages applied to the first the first electrode 1 and the second electrode 53 are shifted by 180 degrees as illustrated by a wave A and a wave B in FIG. 1. Accordingly, the electric fields are generated between the first electrode 53 and the second electrode 54, which cause the toner to hop between the first electrode 53 and the second electrode 54 while reciprocating between the first electrode 53 and the second electrode 54 as illustrated in FIG. 15.

Figure 16:
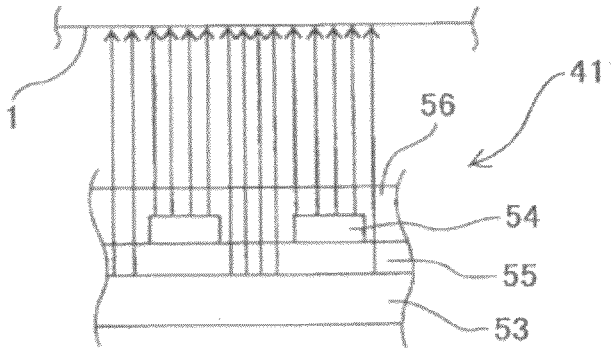
FIG. 16 is a schematic diagram illustrating the electric fields causing the toner to hop from the toner carrier roller to a photoreceptor that are formed between the photoreceptor and the first and the second electrodes on the toner carrier roller.

Meanwhile, when the developing device 4 in the image forming apparatus according to the first embodiment is in the toner discharge mode, the first electrode 53 and the second electrode 54 are supplied with the voltage obtained by superimposing the alternating voltage having the same amplitude and phase indicated by a wave D in FIG. 1 to the direct voltage indicated by a straight line C in FIG. 1. Note that the direct voltage is in a range of −300 to 1000 V, the amplitude Vpp of the alternating voltage is in a range of 1 to 2 kV, and the frequency f of the alternating voltage is in a range of 1 to 5 kHz. Further, since the amplitude (minimum amplitude) of the alternating voltage applied to the first electrode 53 and the second electrode 54 or the direct voltage is greater than the development initiating voltage at the time of toner deterioration, the electric fields are generated between the photoreceptor 1 and the first electrode 53 and the second electrode 54 on the toner carrier roller 41 such that the electric fields may cause the toner to hop from the toner carrier roller 41 to the photoreceptor 1 as illustrated in FIG. 16. Accordingly, the toner may hop from the toner carrier roller 41 toward the photoreceptor 1, that is, the toner is discharged from the toner carrier roller 41 onto the photoreceptor 1 surface and the discharged toner is attached on the photoreceptor 1 surface.

Thus, when the toner is discharged by causing the toner to hop from the toner carrier roller 41 and become attached to the photoreceptor 1, the transfer roller 73 (see FIG. 2) is supplied with the bias voltage greater than −50 V in a minus side that is the electric potential of the photoreceptor 1. Accordingly, the toner attached to the photoreceptor 1 surface may remain attached on the surface of the photoreceptor 1 without being transferred from the photoreceptor 1 surface to the surface of the transfer roller 73 even when the toner is carried into a transfer nip between them.

The toner on the photoreceptor 1 surface that has passed through the transfer nip along with the rotational driving of the photoreceptor 1 is removed (rubbed off) from the photoreceptor 1 surface and collected by the cleaner device 74.

As described above, the developing device 4 in the image forming apparatus according to the first embodiment is capable of detecting the toner flaring and appropriately discharging the deteriorated toner. Thus, the life-span of the developing device 4 may be increased. Further, the developing device 4 is capable of increasing the potential difference between the toner carrier roller 41 and the photoreceptor 1 without breaking the insulator layer 55. Thus, the toner with a low flaring level may be attached to the latent image on the photoreceptor 1 to carry out the development and the deteriorated toner may be discharged from the developing device 4. In addition, the toner flaring may be stabilized to provide a stable image quality.

The toner flaring on the toner carrier roller 41 may be detected by a photosensor.

Figure 17:
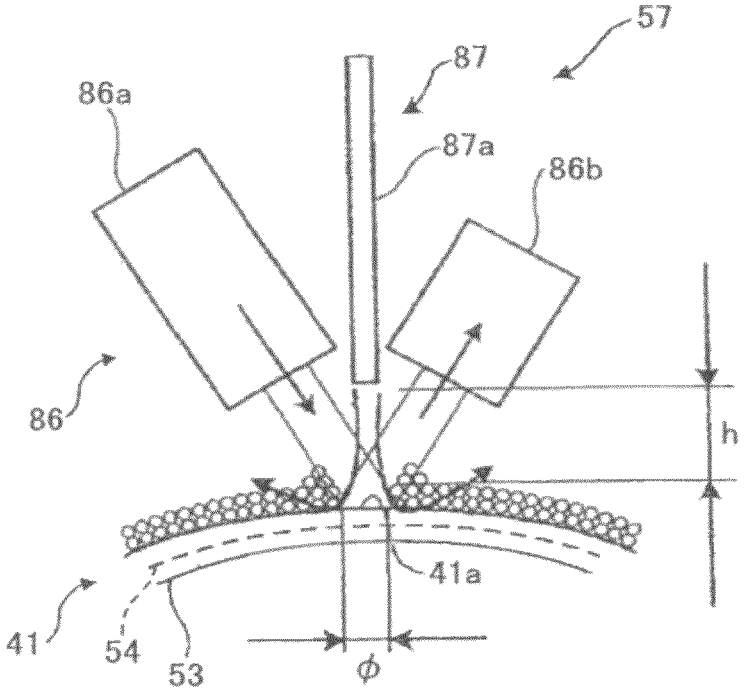
FIG. 17 is a schematic front diagram illustrating a toner flaring level detector provided in the developing device.

As illustrated in FIG. 17, a toner flaring detector 57 utilized as a toner flaring detector is configured to optically detect a surface condition of the toner carrier roller 41; more specifically, the surface condition of the surface layer 56 of the toner carrier roller 41. The toner flaring detector 57 includes a sensor unit 86 formed of a mirror-reflective photosensor utilized as a flaring level detector configured to detect the flaring level of the toner carried on the toner carrier roller 41, and a nozzle unit 87 formed of an air-blower nozzle unit utilized as a fluid blower unit configured to blow air toward the surface of the toner carrier roller 41 optically detected by the sensor unit 86. The sensor unit 86 is controlled by a photosensor controller 30 of the main body controller 100 illustrated in FIG. 5.

The sensor unit 86 includes a laser sensor emitter 86*a* utilized as an emitter formed of a light source configured to emit a laser beam and a laser sensor receiver 86*b* utilized as a receiver configured to receive reflection of the laser beam emitted from the laser sensor emitter 86*a*.

The laser sensor emitter 86*a* emits a laser beam to a position on the surface of the toner carrier roller 41 to which the nozzle unit 87 blows air.

The laser sensor receiver 86*b* outputs a signal based on the intensity of the laser beam reflected off the toner and the surface of the toner carrier roller 41 to a not-illustrated flaring level controller.

Note that the sensor unit 86 utilizes the laser with high sensitivity; however, the light source for the laser may be a light emitting diode (LED).

The nozzle unit 87 includes a nozzle 87*a* having an air blower nozzle port with an internal diameter of 1 mm, and a not-illustrated air compressor utilized as a fluid supplier connected to the nozzle 87*a* and configured to blow air from the nozzle port with a predetermined pressure of 200 Pa (in the first embodiment). The nozzle 87*a* is arranged such that the nozzle port is located at a height h of 2 mm from the surface of the toner carrier roller 41 and is directed toward a part of the surface of the toner carrier roller 41 off which part the laser beam reflects.

Figure 18A:
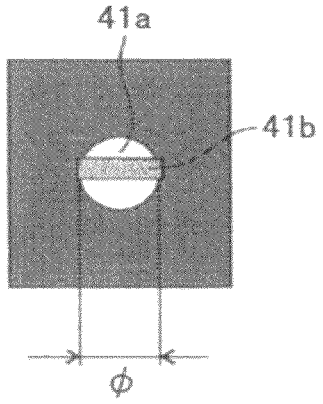
FIGS. 18A and 18B are conceptual diagrams illustrating a developing roller when the toner flaring level detector is in operation.
Figure 18B:
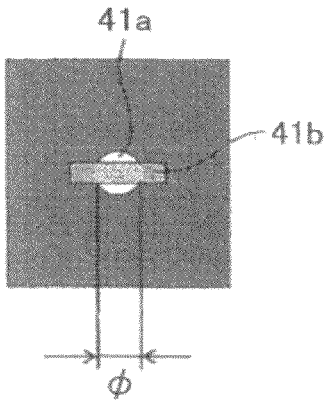

As illustrated in FIGS. 17 and 18, the toner in the flaring state, the amount of which is maintained constant by the regulator blade 43, carried on the surface of the toner carrier roller 41 is blown off by air pressure to form a spot 41*a* that is an exposed portion of the surface of the toner carrier roller 41. The solidly filled part of the periphery of the spot 41*a* in FIGS. 18A and 18B depicts the toner flaring on the surface of the toner carrier roller 41.

When the toner has a high flaring activity ratio and a high flaring level, the toner has low adhesion to the toner carrier roller 41, so that the toner is easily blown off. Thus, the diameter ϕ of the spot 41*a* is increased as illustrated in FIG. 8A. On the other hand, when the toner has a low flaring activity ratio and a low flaring level, the toner has high adhesion to the toner carrier roller 41, so that the toner is not easily blown off. Thus, the diameter ϕ of the spot 41*a* is decreased as illustrated in FIG. 8B.

Note that the "flaring activity ratio" indicates the proportion of the toner that exhibits hopping behavior between the first electrode 53 and the second electrode 54 when the hopping electric fields having predetermined intensity are formed between the first electrode 53 and the second electrode 54. Note also that the "flaring level" indicates the amount of toner flaring in proportion to the total amount of toner. The flaring activity ratio indicates a condition of the toner whereas the toner flaring level indicates a condition of flaring of the toner. Thus, even if the flaring activity ratio is low, the flaring level may be increased by increasing the intensity of the hopping electric field.

In the laser application region 41*b*, since the reflectance of the laser beam may be lowered by the toner flaring in a region outside the spot 41*a*, the reflectance of the laser beam emitted from the laser beam sensor emitter 86*a* is high and the intensity of the laser beam entering into the laser beam sensor receiver 86*b* is high with the spot 41*a* having a large diameter. Note that since an orifice diameter of the nozzle 87*a* is 1 mm, the maximum diameter of the spot 41*a* may be approximately 1 mm. The closer to 100% the flaring activity ratio approaches, the closer to the maximum diameter the diameter of the spot 41*a* approaches.

In measuring the flaring level, it is sufficient that the air blowing be performed to form the spot 41*a* for a time as short as 5 seconds or less. There is no adverse effect of formation of the spot 41*a* on the development. This is because the toner may soon hop and flaring again in a region where the spot 41*a* is formed when the air blowing is stopped.

The nozzle unit 87 may not necessarily be required for measuring the flaring level; however, the accuracy in detecting the flaring level may be increased when the nozzle unit 87 is provided.

Further, an image sensor 75 is provided as an image detector such that the image sensor 75 faces the photoreceptor 1 or a not-illustrated intermediate transfer belt. The image sensor 75 is configured to detect partial intensity or defects of the image forming on the surface of the photoreceptor 1 or the intermediate transfer belt.

When partial defects or inconsistent density of the image are detected by the image sensor 75, an image sensor controller 31 determines that the toner flaring level on the toner carrier roller 41 is low and performs the cleaning and collecting process in the toner discharge mode to discharge the toner on the toner carrier roller 41 onto the photoreceptor 1, which is detected as a suspected cause of the partial defects or inconsistent density of the image. By detecting the defects or inconsistent density of the image and appropriately discharging the toner that is slightly flaring, the image quality may be stabilized and the life-span of the developing device 4 may be increased.

One example of a time at which the image sensor 75 detects the defects and inconsistent density of the image may be as follows. The image sensor 75 may be configured to detect the defects and inconsistent density of the image at a time where a first image operation of the image forming apparatus for forming a first image after a predetermined time has elapsed since a last image forming operation of the image forming apparatus for forming a last image has been conducted. The predetermined time may be measured by a timer 2 of the main body controller 100.

In general, the charge or adhesion of the toner after the predetermined time has passed differ from those of the toner in the normal condition, which may degrade the image quality. Specifically, since the adhesion of the toner to the toner carrier roller 41 is frequently increased in a contact region of the toner supply roller 42 with which the regulator blade 43 is brought into contact, the defects or inconsistent density of the image may be easily induced. Accordingly, if the image sensor 75 is configured to detect the defects and inconsistent density of the image at the time where a first image operation for forming a first image after a predetermined time has elapsed since a last image forming operation for forming a last image has been conducted and the toner that is slightly flaring is appropriately discharged from the toner carrier roller 41 to the photoreceptor 1, the stable image quality may be obtained.

Another example of a time at which the image sensor 75 detects the defects and inconsistent density of the image may be at a time at which the developing operations of images are successively conducted on a predetermined number of sheets. In this example, whether the developing operations are successively conducted on the predetermined number of sheets is determined based on the number of recording sheets fed by a paper feeder.

When the developing operations are successively conducted on the predetermined number of recording sheets, the electrostatic charge of the toner may be increased due to reset failure. As a result, the adhesion of the toner to the toner carrier roller 41 may be increased. Accordingly, the inconsistent toner attachment to the toner supply roller 42 or the regulator blade 43 may induce the inconsistent flaring level of the toner; that is, the toner on some part of the toner carrier roller 41 may exhibit a feasible flaring level whereas the toner on other part of the toner carrier roller 41 may exhibit an inferior flaring level. Accordingly, if the image sensor 75 is configured to detect the defects and inconsistent density of the image at the time at which the developing operations of images have been conducted on the predetermined number of recording sheets and the toner that is slightly flaring is appropriately discharged from the toner carrier roller 41 to the photoreceptor 1, the stable image quality may be obtained.

Further, still another example of a time at which the image sensor 75 detects the defects and inconsistent density of the image may be at a time at which a temperature-humidity environment of the developing device 4 has been changed.

If the temperature-humidity environment of the developing device 4 is drastically changed by the changes of the temperature and humidity of the environment where the developing device 4 resides and condensation is formed on the developing device 4 as a result, the adhesion of the toner to the toner carrier roller 41 may be increased, resulting in no flaring of the toner on the toner carrier roller 41. In this case, much condensation is formed on part of the toner carrier roller 41 near the opening of the developing device 4 and less condensation is formed on part of the toner carrier roller 41 inside of the developing device 4. As a result, significantly inconsistent image intensity may be formed in a roller circumferential direction of the toner carrier roller 41.

Accordingly, a temperature sensor 76 and a humidity sensor 77 are provided near the developing device 4 in the image forming apparatus as illustrated in FIG. 2, and the temperature-humidity environment where the developing device 4 resides may be detected by the temperature sensor 76 controlled by a temperature sensor controller 33 of the main body controller 100 and the humidity sensor 77 controlled by a humidity sensor controller 34 of the main body controller 100. Accordingly, if the image sensor 75 is configured to detect the defects and inconsistent density of the image at the time of the temperature-humidity environment of the developing device 4 having been changed, and the toner that is slightly flaring is appropriately discharged from the toner carrier roller 41 to the photoreceptor 1, the stable image quality may be obtained.

In addition, a development toner amount detector may be provided in the image forming apparatus to detect the amount of toner utilized for the development of the image (i.e., the amount of toner attached to the developed image on the photoreceptor 1), such that a predetermined amount of toner is utilized for the development of the image by controlling the voltage applied to the first electrode 53 or the second electrode 54 of the toner carrier roller 41 based on the detected amount of the toner utilized for the development of the image. If the developing device 4 is capable of controlling the voltage to be applied to the first electrode 53 or the second electrode 54 of the toner carrier roller 41 based on the amount of the toner utilized for the development of the image detected by the development toner amount detector, the appropriate voltage to be applied to the first electrode 53 or the second electrode 54 may be constantly maintained such that the predetermined amount of the toner is utilized for the development of the image, regardless of the environment where the developing device 4 resides.

The development toner detector may be implemented by computing a relationship between predetermined image intensity obtained based on the image intensity detected by the image sensor 75 and the amount of the toner utilized for the development of the image.

In this embodiment, the voltage obtained by superimposing the alternating voltage on the direct voltage may be applied to the first electrode 53 or the second electrode 54 of the toner carrier roller 41 so as to form the alternating electric fields causing the toner to hop from the toner carrier roller 41 toward the photoreceptor 1 and the electric fields causing the toner to hop from the photoreceptor 1 toward the toner carrier roller 41 between the toner carrier roller 41 and the photoreceptor 1. In this case, since the toner carrier roller 41 is attacked by the toner that is reciprocally hopping between the toner carrier roller 41 and the photoreceptor 1, the toner having extremely strong adhesion to the toner carrier roller 41 may be detached from the toner carrier roller 41.

There are three examples of the power supply configuration to apply the voltage to the first electrode 53 or the second electrode 54 of the toner carrier roller 41 in the toner flaring mode or in the toner discharge mode.

The first example of the power supply configuration indicates a configuration where the respective power supplies (first and second power supplies 61 and 62 in this example) are utilized for applying the same voltage to the first electrode 53 and the second electrode 54 in the toner discharge mode, and also for applying different voltages having a potential difference between the first electrode 53 and the second electrode 54 temporarily inverting from each other to the first electrode 53 and the second electrode 54 in the toner flaring mode. That is, the first power supply 61 is utilized for applying the voltage to the first electrode 53 in the toner discharge mode and in the toner flaring mode, and the second power supply 62 is utilized for applying the voltage to the second electrode 54 in the toner discharge mode and in the toner flaring mode as illustrated in FIG. 12A or 12B.

Thus, since the same power supply is utilized in the toner discharge mode and in the toner flaring mode, the number of power supplies may be reduced to lower production cost compared to a case where an additional power supply to be used in the toner discharge mode is separately provided from the first power supply 61 or the second power supply 62 that are utilized in the toner flaring mode. Further, it may be not necessary to provide a switching member or a switching device for switching the first and second power supplies 61 and 62 utilized in the flaring mode to the additional one utilized in the toner discharge mode that is separately provided from the first and second power supplies 61 and 62, and hence the ordinary toner flaring mode and the toner discharge mode may be switched in a short time.

Figure 12C:
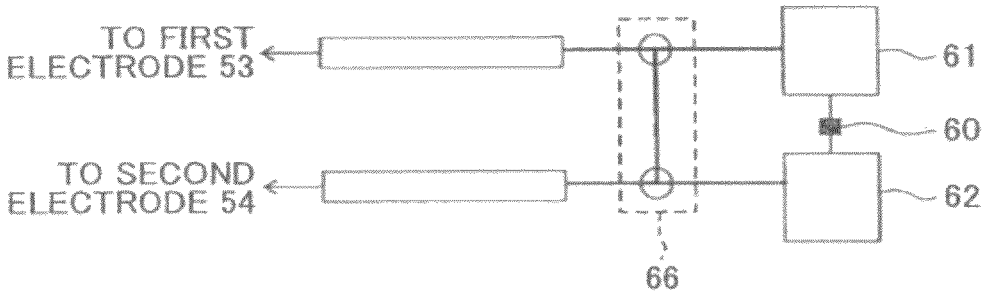
FIG. 12C is a diagram illustrating a configuration of a power supply applying the voltage to the first electrode or the second electrode by utilizing the common power supply shared between the first electrode and the second electrode when the image forming apparatus is in a toner discharge mode.

The second example of the power supply configuration indicates a configuration where the different power supplies (first and second power supplies 61 and 62 in this example) are utilized for applying different voltages having a potential difference between the first electrode 53 and the second electrode 54 temporarily inverting from each other to the first electrode 53 and the second electrode 54 in the toner flaring mode. Meanwhile, the same power supply is utilized for applying the same voltage to the first electrode 53 and the second electrode 54 in the toner discharge mode. That is, the first power supply 61 is utilized for applying the voltage to the first electrode 53 and the second power supply 62 is utilized for applying the voltage to the second electrode 54 in the toner flaring mode as illustrated in FIG. 12A. On the other hand, in the toner discharge mode, the first electrode 53 and the second electrode 54 are electrically coupled as illustrated in FIG. 12C, and a switching device controller 25 of the main body controller 100 controls a switching device 66 to switch the first and second power supplies 61 and 62 such that the first power supply 61 applies the voltage to the first electrode 53 and also to the second electrode 54.

Since the common power supply (i.e., power supply 61 in this example) is utilized for applying the voltage to the first electrode 53 and to the second electrode 54 in the toner discharge mode, consumed power may be lowered to conserve energy compared to a case where the different power supplies are utilized for applying the voltages to the first electrode 53 and the second electrode 54 in the toner discharge mode. Note that in this example, the switching device 66 is also configured to cancel the electrical coupling of the first electrode 53 and the second electrode 54 in the toner flaring mode.

Figure 12D:
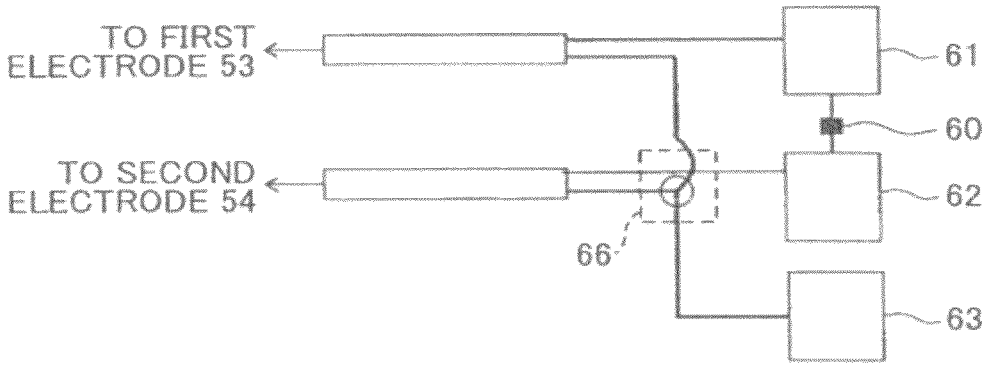
FIG. 12D is a diagram illustrating a configuration of a power supply applying the voltage to the first electrode or the second electrode by utilizing the power supply differing from that used in the toner flaring mode when the image forming apparatus is in a toner discharge mode.

The third example of the power supply configuration indicates a configuration where the respective power supplies (first and second power supplies 61 and 62 in this example) are utilized for applying different voltages having a potential difference between the first electrode 53 and the second electrode 54 temporarily inverting from each other to the first electrode 53 and the second electrode 54 in the toner flaring mode, and the same power supply (a third power supply 63 in this example) is utilized for applying the same voltage to the first electrode 53 and the second electrode 54 in the toner discharge mode. That is, the first power supply 61 is utilized for applying the voltage to the first electrode 53 in the toner flaring mode, and the switching device 66 switches the first power supply 61 to the third power supply 63 in the toner discharge mode such that the third power supply 63 is utilized for applying the voltage to the first electrode 53 in the toner discharge mode as illustrated in FIG. 12D. Further, the second power supply 62 is utilized for applying the voltage to the second electrode 54 in the toner flaring mode, and the switching device 66 switches the second power supply 62 to the third power supply 63 in the toner discharge mode such that the third power supply 63 is utilized for applying the voltage to the second electrode 54 in the toner discharge mode as illustrated in FIG. 12D. Note that in this example, the first power supply 61 or the second power supply 62 is not utilized for applying voltage in the toner discharge mode.

Since the different power supplies for applying the voltage to the first electrode 53 or the second electrode 54 of the toner carrier roller 41 are utilized between the ordinary toner flaring mode and the toner discharge mode, the optimal power supply may be selected for the toner flaring mode and the toner discharge mode. As a result, if the necessary performance greatly differs between the toner flaring mode and the toner discharge mode, the respective power supplies may be effectively designed without waste.

Figure 19:
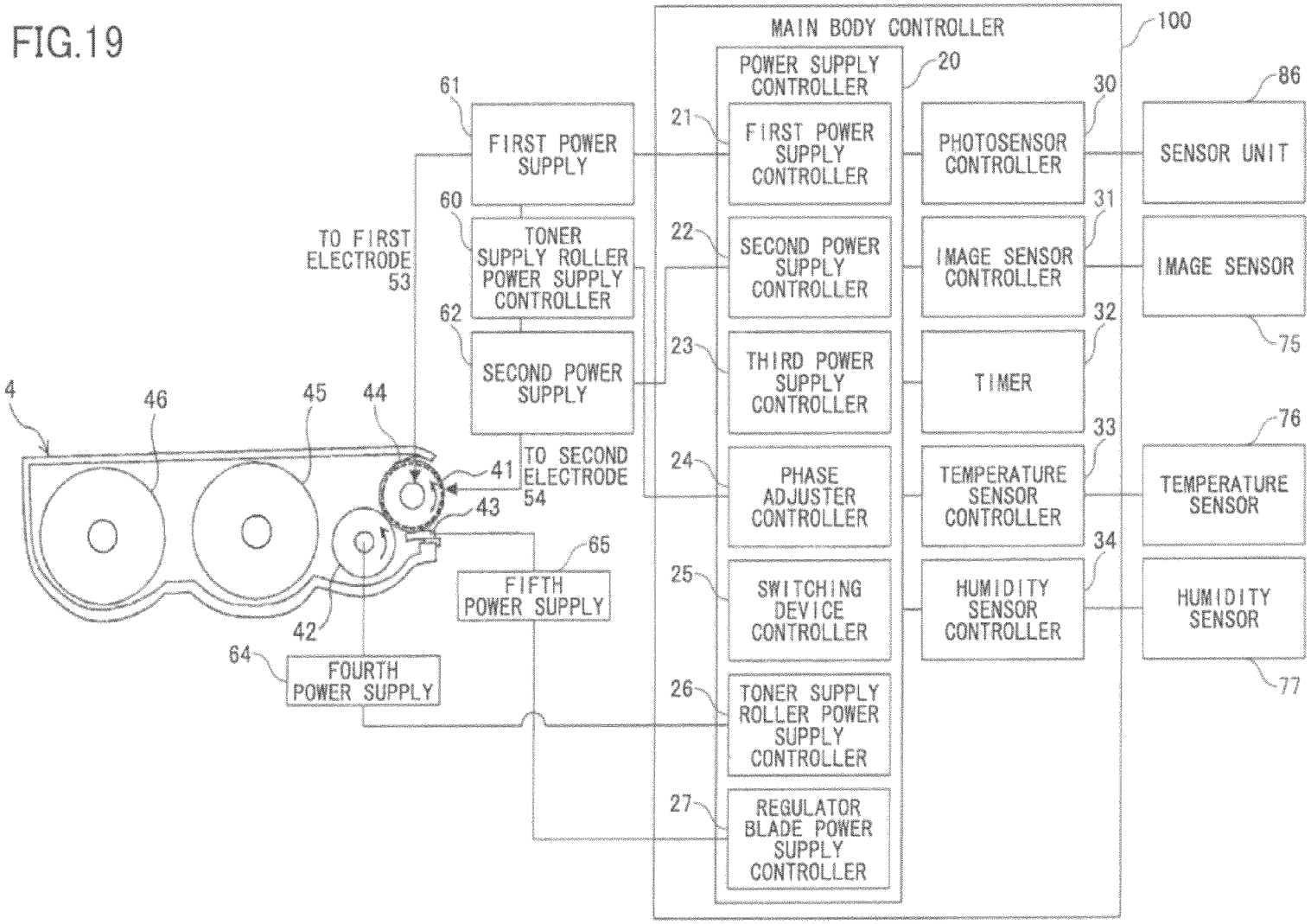
FIG. 19 is a control block diagram illustrating components associated with power supply control of the developing device controlled by a main body controller of the image forming apparatus.

Further, when a high voltage is applied to the first electrode 53 or the second electrode 54 of the toner carrier roller 41 in the toner discharge mode, the current leakage may occur between the toner carrier roller 41 and the toner supply roller 42 due to the potential difference between the toner carrier roller 41 and the toner supply roller 42. Accordingly, a fourth power supply 64 is further provided to apply a voltage to the toner supply roller 42 as illustrated in FIG. 19. With this configuration, a toner supply roller power supply controller 26 of the main body controller 100 controls the fourth power supply 64 to apply to the toner supply roller 42 the voltage the same as that applied to the first electrode 53 or the second electrode 54. With this configuration, the potential difference between the toner carrier roller 41 and the toner supply roller 42 may be almost eliminated and hence the current leakage between the toner carrier roller 41 and the toner supply roller 42 may be prevented.

Likewise, when a high voltage is applied to the first electrode 53 or the second electrode 54 of the toner carrier roller 41 in the toner discharge mode, the current leakage may occur between the toner carrier roller 41 and the regulator blade 43 due to the potential difference between the toner carrier roller 41 and the regulator blade 43. Accordingly, a fifth power supply 65 is further provided to apply a voltage to the regulator blade 43 as illustrated in FIG. 19. With this configuration, a regulator blade power supply controller 27 of the main body controller 100 controls the fifth power supply 65 to apply to the regulator blade 43 the voltage the same as that applied to the first electrode 53 or the second electrode 54.

With this configuration, the potential difference between the toner carrier roller 41 and the regulator blade 43 may be almost eliminated and hence the current leakage between the toner carrier roller 41 and the regulator blade 43 may be prevented.

Further, the first and the second electrodes 53 and 54 are not only supplied with the above-described alternating voltage but also supplied with the direct voltage that is equal to or greater than the development initiating voltage at the time of toner deterioration in the toner discharge mode. Accordingly, the electric fields formed between the photoreceptor 1 and the toner carrier roller 41 may be enhanced such that the toner may hop from the toner carrier roller 41 to the photoreceptor 1 due to enhanced electric fields. As a result, the toner may effectively hop from the toner carrier roller 41 to the photoreceptor 1. Further, the first electrode 53 and the second electrode 54 may be supplied with the same direct voltage, which may almost eliminate the potential difference between the first electrode 53 and the second electrode 54. Accordingly, the breakage of the insulator layer 55 caused by too large potential difference between the first electrode 53 and the second electrode 54 may be prevented while applying the high direct voltage to the first electrode 53 and the second electrode 54.

Second Embodiment

In the flaring developing system, the capacitance of the toner carrier roller 41 may greatly vary with the electrode width of the electrodes formed on the toner carrier roller 41. If the electrode is wide, the capacitance may be reduced, whereas if the electrode is narrow, the capacitance may be increased. Further, if the electrode is too wide, inconsistent density of the electrode pitch may be formed, and the electrode width may need to be sufficiently reduced in such a case. Thus, the capacitance of the toner carrier roller 41 may be large. In this case, since a large amount of current may be required for forming the temporarily varying electric fields capable of effectively allowing the toner to hop on the toner carrier roller 41 having large capacitance, power consumption may be significantly increased.

Thus, the image forming apparatus according to the second embodiment includes a high quality image output mode in which a large amount of current is consumed for outputting high quality images and a low quality image output mode in which a small amount of current is consumed for outputting low quality images, such that the high quality image output mode and the low quality image output mode may be appropriately switched by a user's selecting one of such modes. Accordingly, the power consumption may be reduced compared to a case where the high quality images are constantly produced.

The following examples may be given of the power supply configuration to apply the voltage to the first electrode 53 or the second electrode 54 of the toner carrier roller 41 in the high quality image output mode or in the low quality image output mode.

Figure 20A:
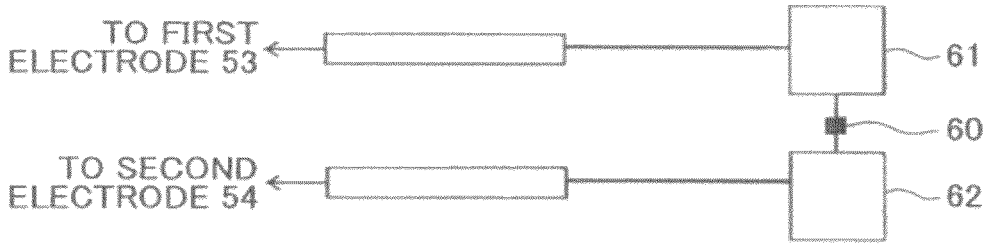
FIG. 20A is a diagram illustrating a configuration of a power supply applied to the first electrode or the second electrode when the image forming apparatus is in a high image quality mode.
Figure 20B:
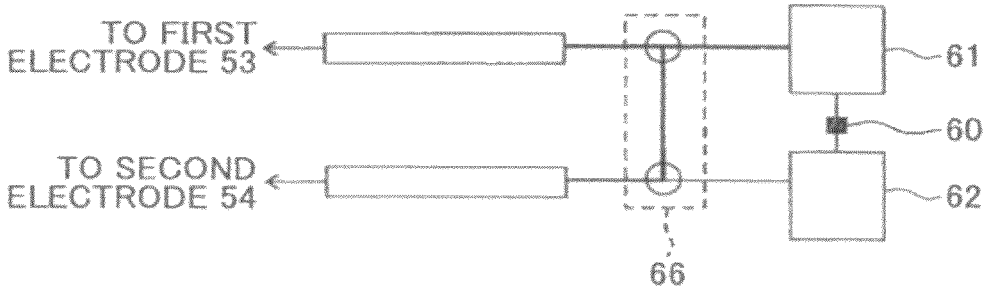
FIG. 20B is a diagram illustrating a configuration of a power supply applied to the first electrode or the second electrode when the image forming apparatus is in a low image quality mode.

In the high quality image output mode, the respective voltages having a potential difference between the first electrode 53 and the second electrode 54 temporarily inverting from each other are applied from the respectively different power supplies to the first electrode 53 and the second electrode 54. In the low quality image output mode, the same voltages are applied from the same power supplies to the first electrode 53 and the second electrode 54. That is, the first power supply 61 is utilized for applying the voltage to the first electrode 53 and the second power supply 62 is utilized for applying the voltage to the second electrode 54 in the high quality image output mode as illustrated in FIG. 20A. Meanwhile, in the low quality image output mode, the switching device 66 illustrated in FIG. 20B electrically couples the first electrode 53 and the second electrode 54, such that the first power supply 61 applies the alternating voltage with the same phase and same amplitude illustrated in FIG. 1 to the first electrode 53 and the second electrode 54 illustrated in FIG. 6. Further, the amplitude of the alternating voltage is greater than the development initiating voltage at the time of toner deterioration. Accordingly, the flaring developing system utilized in the high quality image output mode is switched to the ordinary one-component jumping developing system in the low quality image output mode.

In the low quality image output mode, the alternating voltage Vpp applied to the first electrode 53 or the second electrode 54 may be in a range of 500 to 3000 V. In the second embodiment, the alternating voltage Vpp is set at 1800 V.

When the user selects the low quality image output mode, the voltage that has the same phase and the same amplitude and is greater than the development initiating voltage at the time of toner deterioration is applied to the first electrode 53 and the second electrode 54 of the toner carrier roller 41. This causes the toner to hop from the toner carrier roller 41 to the photoreceptor 1 such that the hopping toner is attached to the latent image formed on the surface of the photoreceptor 1. The development of the image is thus carried out. In this manner, the deteriorated not-flaring toner that is wasted while carrying out the cleaning and collecting process in the toner discharge mode in the first embodiment may be effectively utilized for forming images. Further, since the deteriorated not-flaring toner is discharged from the toner carrier roller 41 in the low quality image output mode, the toner flaring is stabilized and hence the stable image may be produced in the high quality image output mode.

Figure 21:
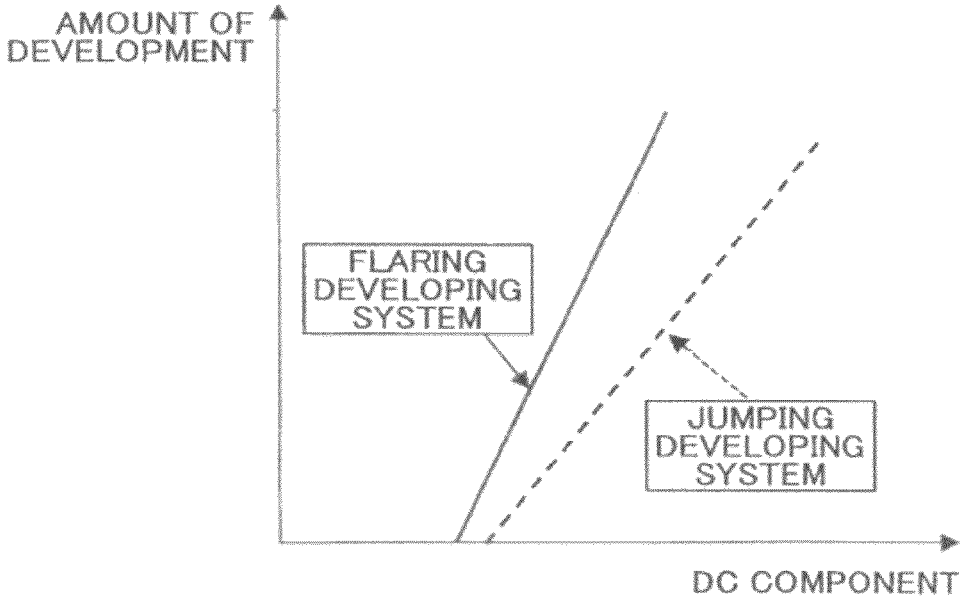
FIG. 21 is a graph illustrating developing characteristics exhibited by a flaring developing system in the high image quality mode and a one-component jumping developing system in the low image quality mode.

Note that the developing characteristics in developing images may differ between the flaring developing system utilized in the high quality image output mode and the one-component jumping developing system utilized in the low quality image output mode as illustrated in FIG. 21. Accordingly, if the same central value (Vdc) of the developing bias is simply set for the high quality image output mode and the low quality image output mode, the image intensity may be changed between the high quality image output mode and the low quality image output mode.

Figure 13A:
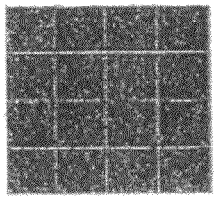
FIG. 13A is a schematic diagram illustrating a high density adjustment pattern.

Accordingly, a patch composed of a high-density filled-in pattern illustrated in FIG. 13A is formed on the surface of the photoreceptor 1 by sequentially altering the central voltage of the developing bias, defecting the amount of toner of the formed patch by the sensor unit 86, and determining the central voltage of the developing bias when the detected amount of toner matches the optimal amount of toner.

Figure 13B:
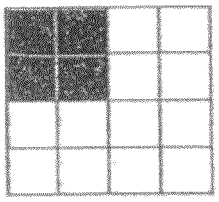
FIG. 13B is a schematic diagram illustrating a low density adjustment pattern.

Alternatively, a patch composed of a low-density pattern illustrated in FIG. 13B is formed on the surface of the photoreceptor 1 by allowing the main body controller 100 serving as an image density adjuster to sequentially alter laser power of the optical writer 3, detecting the amount of toner of the formed patch by the sensor unit 86, and determining the laser power of the optical writer when the detected amount of toner matches the optimal amount of toner.

Further, the patch composed of a high-density filled-in pattern illustrated in FIG. 13A is formed on the surface of the photoreceptor 1 by allowing the main body controller 100 serving as the image density adjuster to control the first power supply 61 or the second power supply 62 such that the first power supply 61 or the second power supply 62 sequentially alters the duty of the developing bias, detecting the amount of toner of the formed patch by the sensor unit 86, and determining the duty of the developing bias when the detected amount of toner matches the optimal amount of toner. In addition, since the areal center (Vavg) of the developing bias is changed by changing the duty of the bias, the effect similar to the change of the DC component may be obtained.

Reference Configuration Example

In the reference configuration example, the voltage obtained by superimposing the alternating voltage on the direct voltage is applied to the first and the second electrodes 53 and 54 of the toner carrier roller 41. In the reference configuration example, the alternating voltage is not changed between the toner flaring forming process and the toner collecting process. That is, the voltages are applied to the respective first electrode 53 and second electrode 54 as illustrated below.

Figure 22:
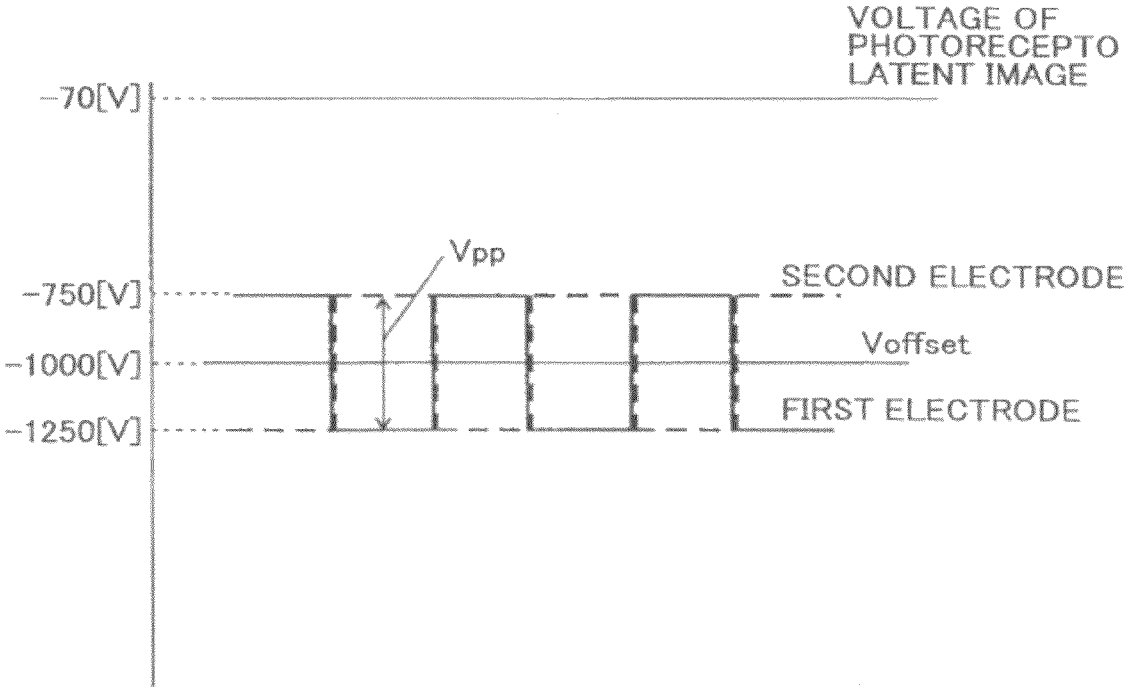
FIG. 22 is a graph illustrating an example where a direct voltage is increased up to −1000 V during a toner collecting process.
Figure 23:
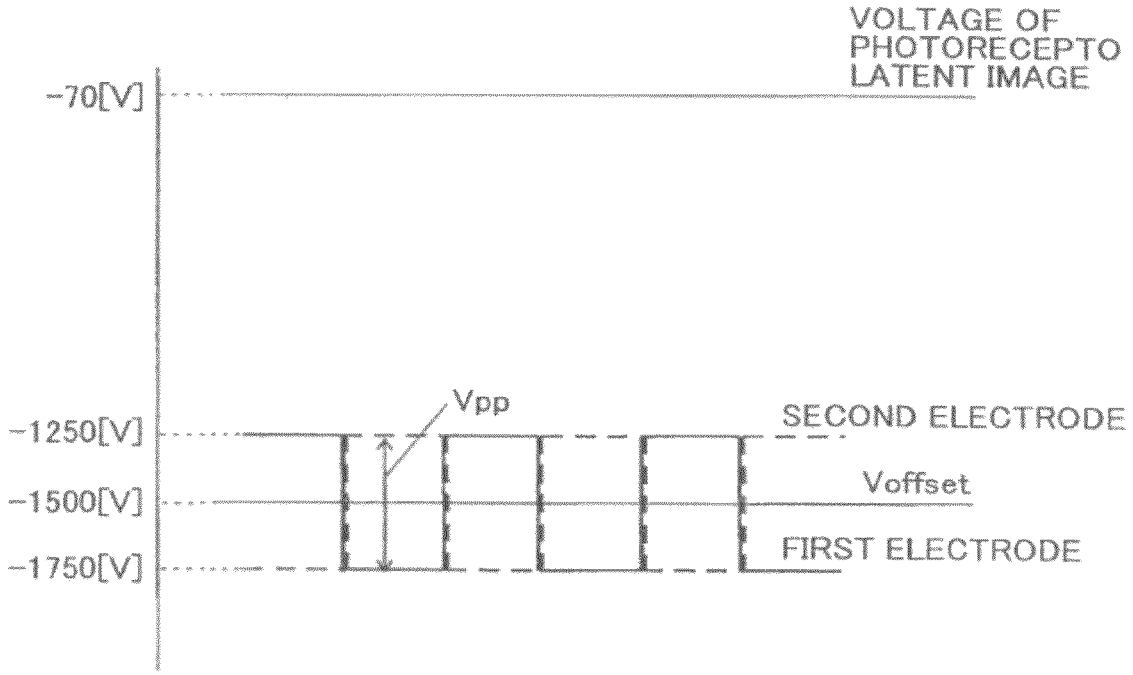
FIG. 23 is a graph illustrating an example where the direct voltage is increased up to −1500 V during the toner collecting process.

On the other hand, the direct voltage applied to the first electrode 53 and the second electrode 54 is greatly changed between the toner flaring forming process and the toner collecting process. FIG. 22 illustrates a case where the direct voltage is increased up to −1000 V at the toner collecting process, whereas FIG. 23 illustrates a case where the direct voltage is increased up to −1500 V at the toner collecting process. Accordingly, the electric fields illustrated in FIGS. 24A to 25B are formed between the first electrode 53 or the second electrode 54 of the toner carrier roller 41 and the photoreceptor 1, such that the electric fields may cause the toner carried on the toner carrier roller 41 to hop from the toner carrier roller 41 to the photoreceptor 1.

In flaring development conducted by the developing device 4 utilized in the reference configuration example, if the potential difference between the first and the second electrodes 53 and 54 is increased too much, the insulator layer 55 may be broken or damaged. If, on the other hand, the direct voltage applied to the first and the second electrodes 53 and 54 is increased without changing the alternating voltage applied to the first and the second electrodes 53 and 54, the potential difference between the photoreceptor 1 and the toner carrier roller 41 is increased such that the electric fields are formed between the photoreceptor 1 and the toner carrier roller 41 to cause the toner to hop from the toner carrier roller 41 to the photoreceptor 1 while allowing the potential difference between the first and the second electrodes 53 and 54 to be unchanged.

Further, in the reference configuration example, the toner flaring detector is provided to detect the toner flaring over the toner carrier roller 41, and the direct voltage applied to the first and the second electrodes 53 and 54 is increased such that the direct voltage is greater than the development initiating voltage at the time of toner deterioration if the toner is not flaring or the toner flaring level is low. Thus, the voltage equal to or greater than the development initiating voltage at the time of toner deterioration may be applied between the photoreceptor 1 and the toner carrier roller 41 to forcibly cause the toner to hop from the toner carrier roller 41 to the photoreceptor 1, thereby forcibly discharging the deteriorated toner.

In the toner discharge mode, the cleaning and collecting processing is conducted. In the cleaning and collecting processing, the deteriorated toner is discharged from the toner carrier roller 41 to the photoreceptor 1, the deteriorated toner is attached onto the photoreceptor 1, and the deteriorated toner attached to the photoreceptor 1 is then removed by the cleaner device 74.

More specifically, in the cleaning and collecting process, initially, the photoreceptor 1 is rotatably driven. Subsequently, when the charger 2 uniformly charges the surface of the photoreceptor 1 to −500 V, the optical writer 3 carried out optical scanning over the entire region of the uniformly charged photoreceptor 1 surface to attenuate the charged voltage of the photoreceptor 1 approximately to −70 V. The rotation of the toner carrier roller 41 is stopped until the attenuated part of the photoreceptor 1 surface enters into the developing region along with the rotational movement of the photoreceptor 1. When the attenuated part of the photoreceptor 1 surface enters into the developing region, the rotationally driving of the toner carrier roller 41 is initiated. At this moment, the first electrode 53 and the second electrode 54 on the toner carrier roller 41 are supplied with the voltage obtained by superimposing the alternating voltage on direct voltage via the first power supply 61 and the second power supply 62 as illustrated in FIG. 12B. In this case, the alternating voltage Vpp=500 V is applied to the first electrode 53 or the second electrode 54 when the direct voltage Voffset=−1000 V as illustrated in FIG. 22; or the alternating voltage Vpp=500 V is applied to the first electrode 53 or the second electrode 54 when the direct voltage Voffset=−1500 as illustrated in FIG. 23. Note that there is a phase difference of 180 degrees between the alternating voltages applied to the first electrode 53 and the second electrode 54. Further, the voltage greater than the development initiating voltage at the time of toner deterioration is applied as the direct voltage. Accordingly, the voltage equal to or greater than the development initiating voltage at the time of toner deterioration is applied between the photoreceptor 1 and the toner carrier roller 41.

When the above-described voltage is applied to the first electrode 53 and the second electrode 54 on the toner carrier roller 41, the electric fields that cause the toner charged with a minus polarity to electrostatically move from the toner carrier roller 41 to the photoreceptor 1 may be formed. Accordingly, the electric fields formed in this manner may cause the toner to hop from the toner carrier roller 41 toward the photoreceptor 1. Thus, the toner may be discharged from the toner carrier roller 41 onto the surface of the photoreceptor 1, thereby allowing the discharged toner to be attached to the surface of the photoreceptor 1. When the toner is discharged by causing the toner to hop from the toner carrier roller 41 and become attached to the photoreceptor 1, the transfer roller 73 is supplied with the bias voltage greater than −70 V in a minus side that is the electric potential of the photoreceptor 1. Accordingly, the toner attached to the photoreceptor 1 surface may remain attached on the surface of the photoreceptor 1 without being transferred from the photoreceptor 1 surface to the surface of the transfer roller 73 even when the toner is carried into the transfer nip.

The toner on the photoreceptor 1 surface that has passed through the transfer nip along with the rotational driving of the photoreceptor 1 is removed (rubbed off) from the photoreceptor 1 surface and collected by the cleaner device 74.

As described above, the developing device 4 in the image forming apparatus according to the second embodiment is capable of detecting the toner flaring and appropriately discharging the deteriorated toner. Thus, the life-span of the developing device 4 may be increased. Further, the developing device 4 is capable of increasing the potential difference between the toner carrier roller 41 and the photoreceptor 1. Thus, the toner with the low flaring level may be attached to the latent image on the photoreceptor 1 to carry out the development and the deteriorated toner may be discharged from the developing device 4. In addition, the toner flaring may be stabilized to provide a stable image quality.

Examples of the method for detecting the toner flaring on the toner carrier roller 41 may include the method for detecting the toner flaring on the toner carrier roller 41 by utilizing the photosensor 86 as illustrated in the first embodiment, and a method for detecting the toner flaring on the toner carrier roller 41 based on the result detected by the image sensor 75.

Further, a development toner amount detector may be provided in the image forming apparatus to detect the amount of toner utilized for the development of the image, such that a predetermined amount of toner is utilized for the development of the image by controlling the voltage applied to the first electrode 53 or the second electrode 54 of the toner carrier roller 41. If the developing device 4 is capable of controlling the voltage to be applied to the first electrode 53 or the second electrode 54 of the toner carrier roller 41 based on the amount of the toner utilized for the development of the image detected by the development toner amount detector, the appropriate voltage to be applied to the first electrode 53 or the second electrode 54 may be constantly maintained such that the predetermined amount of the toner is utilized for the development of the image, regardless of the environment where the developing device 4 resides.

The development toner detector may be implemented by computing a relationship between predetermined image intensity obtained based on the image intensity detected by the image sensor 75 and the amount of the toner utilized for the development of the image.

Next, a method for applying the voltage to the first electrode 53 or the second electrode 54 on the toner carrier roller 41 in the toner discharge mode is described with reference to FIGS. 24A and 24B.

Figure 24B:
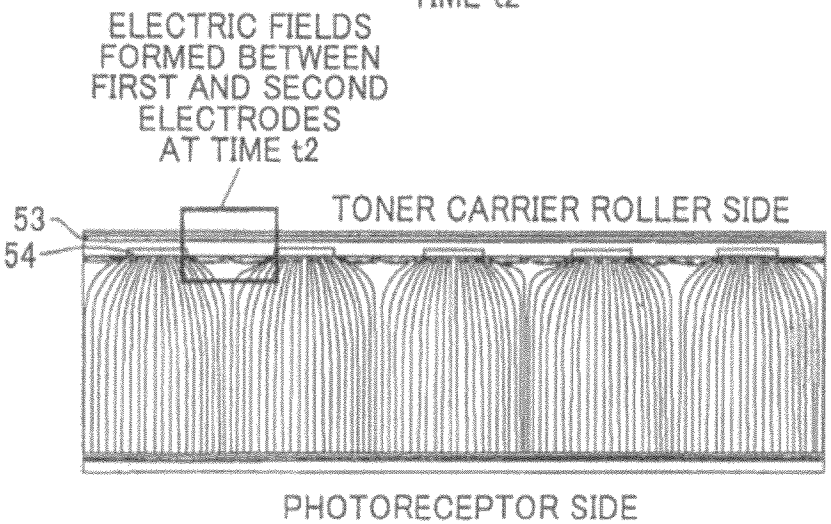
FIGS. 24A and 24B are diagrams illustrating lines of electric force obtained by the voltage applied between the first electrode and the second electrode being inverted at time t1 and time t2 when the direct voltage applied is increased up to −1000 V during the toner collecting process.
Figure 24A:
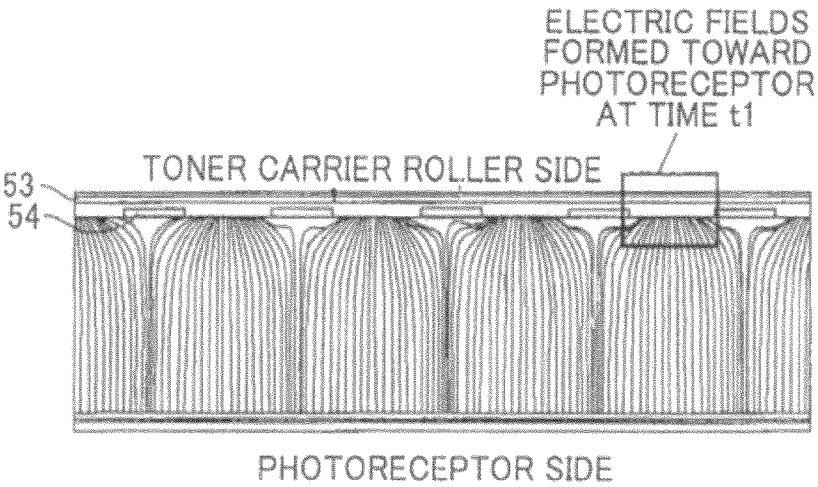

FIGS. 24A and 24B illustrate examples where the potential difference between the first electrode 53 and the second electrode 54 is inverted at time t1 and at time t2. At time t2 illustrated in FIG. 24B, the direct voltage applied to the first electrode 53 and the second electrode 54 is controlled such that the electric fields are formed to cause the toner to hop from the first electrode 53 toward the second electrode 54 or from the second electrode 54 toward the first electrode 53 (i.e., toner reciprocally hopping between the first and the second electrodes 53 and 54) while forming the electric fields to cause the toner to hop from the toner carrier roller 41 toward the photoreceptor 1. By contrast, at time t1 illustrated in FIG. 24A, the direct voltage applied to the first electrode 53 and the second electrode 54 is controlled such that the electric fields are formed between the first electrode 53 and the photoreceptor 1 and also between the second electrode 54 and the photoreceptor 1 such that the toner hops from the toner carrier roller 41 toward the photoreceptor 1 without allowing the forming of the electric fields which would cause the toner to reciprocally hopp between the first and the second electrodes 53 and 54.

Since the electric fields are formed between the first electrode 53 and the second electrode 54 such that the toner is reciprocally hopping between the first electrode 53 and the second electrode 54 at time t2, the toner with less deteriorated flaring level may be reciprocally hopping between the first electrode 53 and the second electrode 54. As a result, when the toner hopping from one of the electrodes is attached to the other electrode, the toner hopping from one of the electrodes collides with the deteriorated toner adhered to the surface of the toner carrier roller 41 to rub off the deteriorated toner from the surface of the toner carrier roller 41. Accordingly, the deteriorated toner may be more effectively discharged from the toner carrier roller 41 to the photoreceptor 1.

Further, an alternative method for applying the voltage to the first electrode 53 or the second electrode 54 on the toner carrier roller 41 in the toner discharge mode is described with reference to FIGS. 25A and 25B.

Figure 25A:
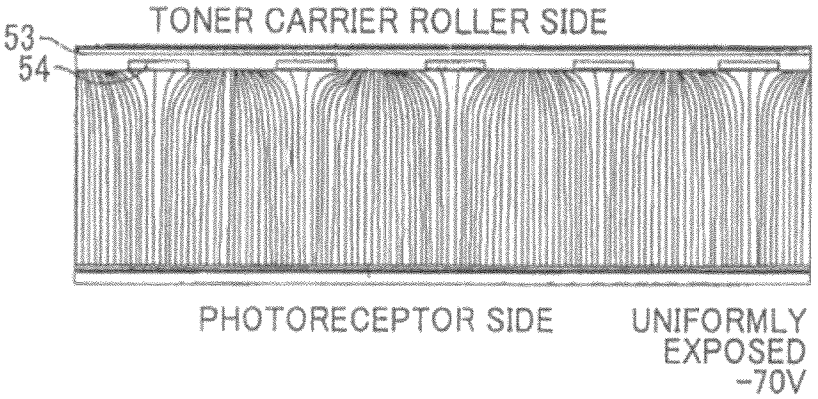
FIGS. 25A and 25B are diagrams illustrating lines of electric force obtained by the voltage applied between the first electrode and the second electrode being inverted at time t1 and time t2 when the direct voltage applied is increased up to −1500 V during the toner collecting process.
Figure 25B:
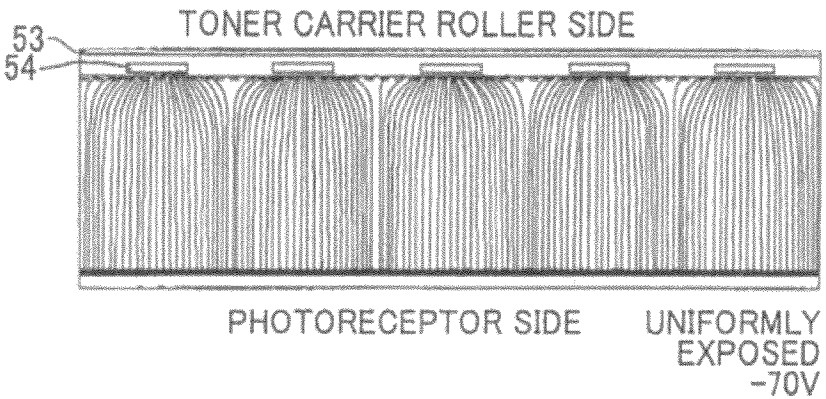

FIGS. 25A and 25B illustrate examples where the potential difference between the first electrode 53 and the second electrode 54 is inverted at time t1 and at time t2. Both at time t1 illustrated in FIG. 25A and at time t2 illustrated in FIG. 25B, the direct voltage applied to the first electrode 53 and the second electrode 54 is controlled such that the electric fields that may cause the toner to hop from the toner carrier roller 41 toward the photoreceptor 1 may be formed without forming the electric fields that may cause the toner to hop from the first electrode 53 toward the second electrode 54 or from the second electrode 54 toward the first electrode 53 (i.e., toner reciprocally hopping between the first and the second electrodes 53 and 54).

Accordingly, since the intensity of the electric fields that may cause the toner to hop from the toner carrier roller 41 to the photoreceptor 1 may be increased, the image may be developed with the toner including the completely not-flaring toner and the deteriorated toner (not-flaring toner) may be discharged from the toner carrier roller 41 to the photoreceptor 1.

Further, when a high voltage is applied to the first electrode 53 or the second electrode 54 of the toner carrier roller 41 in the toner discharge mode, the current leakage may occur between the toner carrier roller 41 and the toner supply roller 42 due to the potential difference between the toner carrier roller 41 and the toner supply roller 42. Accordingly, an additional power supply may be provided for applying a voltage to the toner supply roller 42, such that the toner supply roller 42 may be supplied with the same voltage as that supplied to the first electrode 53 or the second electrode 54. Accordingly, the potential difference between the toner carrier roller 41 and the toner supply roller 42 may be almost eliminated and hence the current leakage between the toner carrier roller 41 and the toner supply roller 42 may be prevented.

Likewise, when a high voltage is applied to the first electrode 53 or the second electrode 54 of the toner carrier roller 41 in the toner discharge mode, the current leakage may occur between the toner carrier roller 41 and the regulator blade 43 due to the potential difference between the toner carrier roller 41 and the regulator blade 43. Accordingly, an additional power supply may be provided for applying a voltage to the regulator blade 43, such that the regulator blade 43 may be supplied with the same voltage as that supplied to the first electrode 53 or the second electrode 54. Thus, the potential difference between the toner carrier roller 41 and the regulator blade 43 may be almost eliminated and hence the current leakage between the toner carrier roller 41 and the regulator blade 43 may be prevented.

According to the first and second embodiments, there is provided an image forming apparatus that includes: a photoreceptor 1 utilized as a latent image carrier; an optical writer 3 utilized as a latent image writing unit configured to write a latent image on the photoreceptor 1; a developing device 4 utilized as a developing unit having a toner carrier roller 41 having a first electrode 53 and a second electrode 54 that are insulated from each other via an insulator layer 55 utilized as an insulator member; a first power supply 61 and a second power supply 62 utilized as voltage applying units configured to apply respective voltages to the first electrode 53 and the second electrode 54 to form first electric fields due to a potential difference between the first electrode 53 and the second electrode 54 such that the first electric fields cause toner to hop from the toner carrier roller 41 to the photoreceptor 1 to develop a toner image by attaching the hopping toner to a latent image formed on the photoreceptor 1; and a transfer roller 73 utilized as a transfer unit configured to transfer the toner image developed on the photoreceptor 1. In such an image forming apparatus, alternating voltages having a same phase and a same amplitude are applied to the first electrode 53 and the second electrode 54 to form second electric fields between the photoreceptor 1 and the toner carrier roller 41 such that the second electric fields between the photoreceptor 1 and the toner carrier roller 41 cause the toner to hop from the toner carrier roller 41 to the photoreceptor 1 to discharge the toner from the toner carrier roller 41 to the photoreceptor 1. With this configuration, since the respective alternating voltages applied to the first and the second electrodes 53 and 54 on the toner carrier roller 41 have the same phase and the same amplitude, the potential difference may not occur between the first and the second electrodes 53 and 54. Accordingly, the insulator layer 55 may not be broken due to a current leakage between the first and the second electrodes 53 and 54. Thus, the alternating voltages relatively greater than those applied to the electrodes having a high potential difference between the electrodes may be applied to the respective first and second electrodes 53 and 54. Accordingly, the electric fields may be formed between the toner carrier roller 41 and the photoreceptor 1 by setting the potential difference between the toner carrier roller 41 and the photoreceptor 1 greater than the potential difference between the two electrodes such that the electric fields formed between the toner carrier roller 41 and the photoreceptor 1 may cause the toner having lowered electrostatic charge to hop from the toner carrier roller 41 to the photoreceptor 1. The toner having the lowered electrostatic charge may be discharged from the toner carrier roller 41 to the photoreceptor 1. Thus, the toner having the drastically lowered electrostatic charge may be discharged from the toner carrier roller 41 to the photoreceptor 1 while suppressing breakage of the insulator 55.

According to the first embodiment, the image forming apparatus further includes a cleaner device 74 configured to clean the surface of the photoreceptor 1; and a toner flaring detector 57 utilized as a toner flaring detector configured to detect flaring of the toner on the surface of the toner carrier roller 41. In the image forming apparatus having such a configuration, when a result detected by the toner flaring detector 57 indicates that the toner on the surface of the toner carrier roller 41 does not satisfy a predetermined flaring condition, alternating voltages having the same phase and the same amplitude, the amplitude being greater than the development initiating voltage at the time of toner deterioration, are applied to the first electrode 53 and the second electrode 54 such that while the toner on the surface of the toner carrier roller 41 is transferred from the surface of the toner carrier roller 41 to the surface of the photoreceptor 1, the toner transferred on the surface of the photoreceptor 1 is collected by the cleaner device 74 to carry out a cleaning and collecting process. Accordingly, the developing device 4 in the image forming apparatus may appropriately discharge the deteriorated toner, and the life-span of the developing device 4 may be increased. Further, the developing device 4 may increase the potential difference between the toner carrier roller 41 and the photoreceptor 1 without breaking the insulator layer 55. Thus, the toner with a low flaring level may still be attached to the latent image formed on the photoreceptor 1 to carry out the development of the image, and the deteriorated toner may be discharged from the developing device 4. In addition, the toner flaring may be stabilized to provide a stable image quality.

Further, according to the second embodiment, the user may be able to select one of a high quality image output mode and a low quality image output mode in the image forming apparatus. If the user selects the low quality image output mode, the alternating voltages having the same phase and the same amplitude that are greater than the development initiating voltage at the time of toner deterioration are applied to the first electrode 53 and the second electrode 54 of the toner carrier roller 41. Accordingly, the toner is caused to hop from the toner carrier roller 2 to the photoreceptor 1 such that the hopping toner is transferred to the latent image formed on the surface of the photoreceptor 1 to carry out the development of the image. Thus, the deteriorated not-flaring toner that is wasted while carrying out the cleaning and collecting process in the toner discharge mode in the first embodiment may be effectively utilized for forming images. Further, since the deteriorated not-flaring toner is discharged from the toner carrier roller 41 in the low quality image output mode, the toner flaring is stabilized and hence the stable image may be produced in the high quality image output mode.

Further, according to the second embodiment, the image forming apparatus further includes a main body controller 100 utilized as an image density adjuster configured to adjust density of the toner image by altering laser power of the optical writer 3 or by altering the developing bias such that the developed toner image includes appropriate density. Note that duty of the alternating voltages may also be changed when changing the developing bias.

According to the first embodiment, the image forming apparatus includes the cleaner device 74 configured to clean the surface of the photoreceptor 1; and an image sensor 75 utilized as an image detector configured to detect defects of the toner image or inconsistent density of the toner image. In the image forming apparatus having such a configuration, when a result detected by the toner flaring detector 75 indicates that there is a defect of the toner image or inconsistent density of the toner image, alternating voltages having the same phase and the same amplitude, the amplitude being greater than the development initiating voltage at the time of toner deterioration, are applied to the first electrode 53 and the second electrode 54 such that while the toner on the surface of the toner carrier roller 41 is transferred from the surface of the toner carrier roller 41 to the surface of the photoreceptor 1, the toner transferred on the surface of the photoreceptor 1 is collected by the cleaner device 74 to carry out a cleaning and collecting process. Accordingly, the developing device 4 in the image forming apparatus may appropriately discharge the not-flaring deteriorated toner, and the image quality may be stabilized and the life-span of the developing device 4 may be increased.

Further, according to the first embodiment, the defect or inconsistent density of the image may be detected by the image sensor 75 at a time where a first image operation for forming a first image after a predetermined time has elapsed since a last image forming operation for forming a last image has been conducted. Accordingly, the charged amount or the attached amount of the toner after the predetermined time has elapsed since the last image forming operation has been conducted may differ from those of the toner in an ordinary time to produce an image with degraded image quality. However, in such a case, the deteriorated toner that is slightly flaring may be appropriately discharged from the toner carrier roller 41 to the photoreceptor 1, and hence the stable image quality may be obtained.

Further, according to the first embodiment, the defect or inconsistent density of the image may be detected by the image sensor 75 when the developing device 4 sequentially conducts development operations of images on a predetermined number of recording sheets. Accordingly, the charge amounts that may be increased due to reset failure differ, which may increase the adhesion of the toner to the toner carrier roller 41. However, in such a case, the adhering toner that is slightly flaring may be appropriately discharged from the toner carrier roller 41 to the photoreceptor 1, and hence the stable image quality may be obtained.

Further, according to the first embodiment, the defect or inconsistent density of the image may be detected by the image sensor 75 when the temperature and humidity environment where the developing device 4 resides is changed. Accordingly, when the condemnation is obtained on the toner carrier roller 41 due to the drastic change in the temperature and humidity environment of the developing device 4, the adhesion of the toner to the toner carrier roller 41 may be increased, which may inhibit flaring of the toner on the toner carrier roller 41. However, in such a case, the adhering toner that is slightly flaring may be appropriately discharged from the toner carrier roller 41 to the photoreceptor 1, and hence the stable image quality may be obtained.

According to the first and the second embodiments, the image forming apparatus further includes the toner supply roller 42 utilized as a toner supply member configured to supply the toner to the toner carrier roller 41 provided in the developing device 4; and a fourth supply power 64 utilized as a toner supply member voltage applying unit configured to apply a voltage the same as those applied to the first and the second electrodes 53 and 54 to the toner supply roller 42. Accordingly, the potential difference between the toner carrier roller 41 and the toner supply roller 42 may be almost eliminated and hence the current leakage between the toner carrier roller 41 and the toner supply roller 42 may be prevented.

According to the first and the second embodiments, the image forming apparatus further includes the regulator blade 43 utilized as a toner regulator member configured to regulate an amount of the toner on the toner carrier roller 41 provided in the developing device 4; and a fifth supply power 65 utilized as a voltage applying unit configured to apply a voltage the same as those applied to the first and the second electrodes 53 and 54 to the regulator blade 43. Accordingly, the potential difference between the toner carrier roller 41 and the regulator blade 43 may be almost eliminated and hence the current leakage between the toner carrier roller 41 and the regulator blade 43 may be prevented. Further, according to the first and the second embodiments, in the image forming apparatus, the toner carrier roller 41 includes the internally integrated first electrode 53, the insulator layer 55 covering the first electrode 53, the second electrode 54 formed on the insulator layer 55, and the surface layer 56 covering the insulator layer 55 and the second electrode 54 formed on the outer circumferential surface of the toner carrier roller 41. In order to cause the toner to be flared, substantially strong hopping electric fields may need to be formed. Thus, it may be necessary to generate a significantly large potential difference between the first electrode 53 and the second electrode 54 for forming such strong hopping electric fields. However, in order to generate such a significantly large potential difference between the first electrode 53 and the second electrode 54, the first electrode 53 may need to be efficiently insulated from the second electrode 54 with stability to prevent the current from leaking via intervals between the first electrode 53 and the second electrode 54. Note that if two different types of electrodes are concentrically formed in a comb-like (ladder-like) shape on the cylindrical insulator substrate as the first electrode and the second electrode and narrow pointed teeth along one side of the first electrode are alternately arranged between narrow pointed teeth along the other side of the second electrode, the insulating property between the two electrodes may be drastically reduced due to the structural defects in forming the electrodes, which may induce the current leakage from the intervals between the two electrodes. Accordingly, hopping electric fields may not appropriately be formed. However, if the insulator layer 55 is formed on the first electrode 53 and the comb-like (ladder-like) second electrode 54 is formed on the insulator layer 55, there are no interfaces that may cause the current leakage from the intervals between the two electrodes 53 and 54. Further, the conductive material that is a possible factor of the current leakage may hardly intrude in the intervals between the two electrodes in forming the toner carrier roller 41. Accordingly, the first electrode 53 may be effectively insulated from the second electrode 54 with stability, and even if a relatively high voltage is applied to the electrodes, the current leakage may be effectively prevented.

Further, in the first and the second embodiments, the image formed by superimposing plural toner images on the photoreceptor 1 is transferred by the transfer roller 73 onto the recording material utilized as a transferring member. In the image forming apparatus having this configuration, since the four color images are recorded on the surface of the same photoreceptor 1, positional deviations in superimposing the four color images scarcely occur, compared to a generally used tandem type image forming apparatus including four photoreceptors from which different color images are superimposed to form a full-color image.

Figure 26:
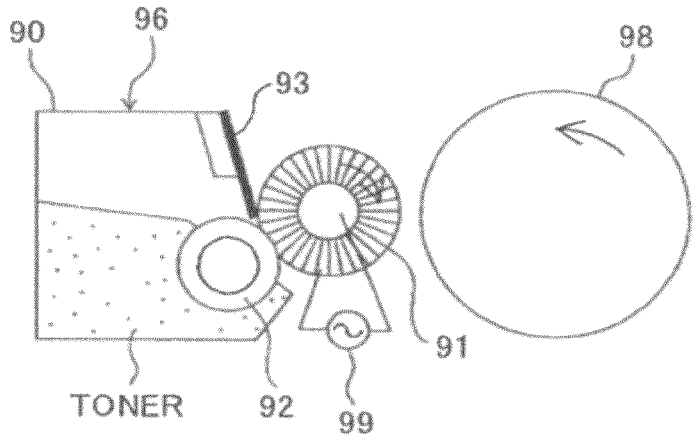
FIG. 26 is a diagram illustrating another configuration of the photoreceptor and the developing device.

Note that in the first and second embodiments, a belt-type photoreceptor is utilized as the photoreceptor 1. However, the photoreceptor 1 may be a drum-type photoreceptor as illustrated in FIG. 26. Further, in a developing device 96 illustrated in FIG. 26, toner is contained in a toner container 90, and a toner supply roller 92 scoops up the toner and supplies it onto a toner carrier roller 91. The toner supplied on the toner carrier roller 91 is then carried to a regulator blade 93 utilized as a regulator unit. The regulator blade 93 regulates the amount of the toner and also charges the toner on the toner carrier roller. Electrodes formed on the toner carrier roller 91 are then supplied with the alternating voltage via a power supply 99 to cause the charged toner carried on the toner carrier roller 91 to hop. The hopping toner on the toner carrier roller 91 is thus carried to the developing region while exhibiting the hopping behavior. The preferable waveform of the alternating voltage applied to the toner carrier roller 91 is a rectangular wave; however, the waveform of the alternating voltage applied to the toner carrier roller 91 may be a sine wave or a triangular wave. Further, alternating voltages having a phase difference n are applied to the two adjacent electrodes on the surface of the toner carrier roller. In the developing region, the toner is attracted from the toner carrier roller 91 and attached to the latent image formed on the surface of a photoreceptor drum 98 due to the difference between the average electric potential of the surface of the toner carrier roller 91 and the potential of the surface of the photoreceptor drum 98, which results in forming the toner image. The toner remaining on the surface of the toner carrier roller 91 which is not utilized for the development of the image and thus has passed through the developing region is returned to the toner container 90. By repeating the above, a constant amount of the toner flaring may be formed on the surface of the toner carrier roller 91.

Further, since the respective alternating voltages applied to the two electrodes on the toner carrier roller have the same phase and amplitude, the current leakage may not occur between the two electrodes and hence the insulator layer may not be broken due to the current leakage. Thus, the alternating voltages relatively greater than those applied to the electrodes having a large potential difference may be applied to the respective two electrodes. Accordingly, the electric fields may be formed by setting the potential difference between the toner carrier and the latent image carrier to be greater than the potential difference between the two electrodes such that the electric fields may cause the toner having degraded electrostatic charge to hop from the toner carrier to the latent image carrier. The toner having the degraded electrostatic charge is discharged from the toner carrier in this manner.

According to the first and second embodiments, there is provided the image forming apparatus that exhibits excellent advantages and is capable of discharging the toner having the drastically lowered electrostatic charge from the toner carrier roller onto the latent image carrier while suppressing inducement of insulator breakage.

Further, the present invention is not limited to these embodiments, but various variations and modifications may be made without departing from the scope of the present invention.

The present application is based on Japanese Priority Application No. 2010-200030 filed on Sep. 7, 2010, and Japanese Priority Application No. 2011-125383 filed on Jun. 3, 2011, with the Japanese Patent Office, the entire contents of which are hereby incorporated by reference.

What is claimed is:

1. An image forming apparatus comprising:

a latent image carrier configured to carry a latent image;

a latent image writer configured to write the latent image on the latent image carrier;

a developing unit including a toner carrier configured to carry toner, the toner carrier including a first electrode and a second electrode arranged along a surface thereof, the first electrode and the second electrode being insulated from each other via an insulator member, and a voltage applying unit configured to apply voltages to the first electrode and the second electrode such that first electric fields formed by a potential difference between the first electrode and the second electrode cause the toner to hop from the toner carrier to the latent image carrier to attach the hopping toner to the latent image formed on the latent image carrier to develop a toner image on the latent image carrier; and a transfer unit configured to transfer the toner image developed on the latent image carrier to a transferring member, wherein, when alternating voltages are applied to the first electrode and the second electrode in a toner discharge mode, the alternating voltages having a same phase and a same amplitude and forming second electric fields between the latent image carrier and the toner carrier to cause the toner to hop from the toner carrier toward the latent image carrier, the toner is discharged from the toner carrier to the latent image carrier in the toner discharge mode.

2. The image forming apparatus as claimed in claim 1, further comprising:

a cleaning unit configured to clean a surface of the latent image carrier; and a toner flaring detector configured to detect flaring of the toner on the toner carrier, wherein when a result detected by the toner flaring detector indicates that the flaring of the toner on the toner carrier does not satisfy a predetermined flaring condition, the alternating voltages having a same phase and a same amplitude, the amplitude being greater than that of a development initiating voltage, are applied to the first electrode and the second electrode to cause the toner on the surface of the toner carrier to be transferred to a surface of the latent image carrier and the toner transferred onto the surface of the latent image carrier is collected by the cleaning unit to carry out a cleaning and collecting process.

3. The image forming apparatus as claimed in claim 1, wherein, when one of a high resolution image mode and a low resolution image mode is selectable for outputting an image, and the low resolution image mode is selected for outputting the image having low resolution, the alternating voltages having a same phase and a same amplitude, the amplitude being greater than that of a development initiating voltage, are applied to the first electrode and the second electrode to cause the toner on the surface of the toner carrier to be transferred to a surface of the latent image carrier to develop the latent image formed on the surface of the latent image carrier.

4. The image forming apparatus as claimed in claim 3, further comprising:

an image density adjuster configured to adjust, when the selected one of the high resolution image mode and the low resolution image mode is changed to the other one, density of the toner image such that the toner image has an appropriate density.

5. The image forming apparatus as claimed in claim 4, wherein the image density adjuster adjusts the density of the toner image by changing laser power of the latent image writer such that the toner image has the appropriate density.

6. The image forming apparatus as claimed in claim 4, wherein the image density adjuster adjusts the density of the toner image by changing a developing bias such that the toner image has the appropriate density.

7. The image forming apparatus as claimed in claim 6, wherein when changing the developing bias, duty of the alternating voltages are changed.

8. The image forming apparatus as claimed in claim 1, further comprising:

a cleaning unit configured to clean a surface of the latent image carrier; and an image detector configured to detect a defect of the toner image or an inconsistent density of the toner image, wherein when a result detected by the image detector indicates that there is the defect of the toner image or the inconsistent density of the toner image, the alternating voltages having a same phase and a same amplitude, the amplitude being greater than that of a development initiating voltage, are applied to the first electrode and the second electrode to cause the toner on the surface of the toner carrier to be transferred to the surface of the latent image carrier and the toner transferred onto the surface of the latent image carrier is collected by the cleaning unit to carry out a cleaning and collecting process.

9. The image forming apparatus as claimed in claim 8, wherein the image detector detects the defect or the inconsistent density of the toner image at a time where a first image operation for forming a first image after a predetermined time has elapsed since a last image forming operation for forming a last image has been conducted.

10. The image forming apparatus as claimed in claim 8, wherein the image detector detects the defect or the inconsistent density of the toner image at a time where the developing unit sequentially develops the toner image on a predetermined number of transferring members.

11. The image forming apparatus as claimed in claim 8, wherein the image detector detects the defect or the inconsistent density of the toner image at a time where a temperature and humidity environment in which the developing unit resides is changed.

12. The image forming apparatus as claimed in claim 1, further comprising:

a toner supply member arranged in the developing unit and configured to supply toner on the toner carrier; and a toner supply member voltage applying unit configured to apply a voltage the same as the respective voltages applied to the first electrode and the second electrode to the toner supply member.

13. The image forming apparatus as claimed in claim 1, further comprising:

a regulator member arranged in the developing unit and configured to regulate an amount of toner supplied on the toner carrier; and a regulator member voltage applying unit configured to apply a voltage the same as the respective voltages applied to the first electrode and the second electrode to the regulator member.

14. The image forming apparatus as claimed in claim 1, wherein the toner carrier includes an internally integrated first electrode, an insulator layer covering the first electrode, a second electrode formed on the insulator layer, and a surface layer covering the insulator layer and the second electrode formed on an outer circumferential surface of the toner carrier.

15. The image forming apparatus as claimed in claim 1, wherein the transfer unit transfers an image formed by superimposing plural toner images on the latent image carrier onto the transferring member.

16. A developing device used in an image forming apparatus, comprising:

a toner carrier to carry toner, the toner carrier including:

a first electrode arranged along a surface thereof, a second electrode arranged along the surface thereof, and an insulator member to insulate the first electrode and the second electrode from each other; and a voltage applying unit to apply voltages to the first electrode and the second electrode, the voltage applying unit to apply first voltages forming first electric fields which cause the toner to hop from the toner carrier to a latent image carrier of the image forming apparatus, wherein, in a toner discharge mode, the voltage applying unit applies second voltages forming second electric fields which cause the toner to be discharged from the toner carrier to the latent image carrier, and wherein said second voltages are alternating voltages having a same phase and a same amplitude.

17. The developing device as claimed in claim 16, wherein an amplitude of the second voltages are larger than an amplitude of the first voltages.

18. The developing device as claimed in claim 16, further comprising:

a toner supply member to supply the toner on the toner carrier.

19. The developing device as claimed in claim 16, further comprising:

a regulator member to regulate an amount of the toner supplied on the toner carrier.

20. The image forming apparatus as claimed in claim 16, wherein the first electrode is disposed directly against the surface of the toner carrier and the second electrode is layered on top of the first electrode having a layer of the insulator member therebetween.

* * * * *